US010980291B2

(12) United States Patent
Inzer

(10) Patent No.: US 10,980,291 B2
(45) **Date of Patent: *Apr. 20, 2021**

(54) ADJUSTABLE SUIT

(71) Applicant: John Inzer, Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 15/969,844

(22) Filed: May 3, 2018

(65) Prior Publication Data

US 2018/0249768 A1 Sep. 6, 2018

Related U.S. Application Data

(63) Continuation of application No. 14/809,403, filed on Jul. 27, 2015, now Pat. No. 9,999,264.

(51) Int. Cl.
*A41D 13/00* (2006.01)
*A41D 1/08* (2018.01)
(Continued)

(52) U.S. Cl.
CPC ..... *A41D 13/0015* (2013.01); *A41D 1/08* (2013.01); *A41D 1/089* (2018.01); *A41D 31/18* (2019.02)

(58) Field of Classification Search
CPC ..... A41D 13/0015; A41D 1/089; A41D 7/00; A41D 27/28; A41D 27/285; A41D 31/18;
(Continued)

(56) References Cited

U.S. PATENT DOCUMENTS 188,940 A 3/1877 Paokschee
280,444 A 7/1883 Bush
(Continued)

FOREIGN PATENT DOCUMENTS

CA 2646918 A1 6/2010
DE 2302607 A1 7/1974
(Continued)

OTHER PUBLICATIONS

U.S. Final Office Action dated Dec. 13, 2018 pertaining to U.S. Appl. No. 14/809,434.

*Primary Examiner* — Alissa L Hoey
(74) *Attorney, Agent, or Firm* — Dinsmore & Shohl LLP

(57) ABSTRACT

An adjustable suit is provided and comprises fabric selected from the group consisting of single or multi-ply polymeric fabric and fabric from natural fibers. The adjustable suit includes a waist section having a front portion and a back portion and a waist section circumference, and a leg section including a pair of legs, each of the legs having a leg opening therein. Each of the leg openings has a leg opening circumference. The adjustable suit includes first, second, third and fourth adjustable members extending along the waist and leg sections. The first and second adjustable members are positioned on one side of a sagittal plane extending longitudinally along the waist and leg sections, and the third and fourth adjustable members are positioned on an opposite side of the sagittal plane of the suit and extend along the waist and leg sections. The second and third adjustable members comprise zippers, and the first, second, third, and fourth adjustable members are adapted to increase or decrease at least one of the waist and leg opening circumferences.

27 Claims, 20 Drawing Sheets

(51) Int. Cl.
*A41D 1/089* (2018.01)
*A41D 31/18* (2019.01)

(58) Field of Classification Search
CPC ... A41D 2400/38; A41D 13/1281; A41F 1/04; A41F 1/008; A41B 13/005
USPC ..... 2/79, 71, 75, 80, 340, 114
See application file for complete search history.

(56) References Cited

U.S. PATENT DOCUMENTS 362,565 A 5/1887 Yarwood
682,503 A 9/1901 Strasburger
1,061,697 A 5/1913 Sobra
1,405,405 A * 2/1922 Gendel ..... A41D 11/00 2/80
1,641,487 A * 9/1927 Hockmeyer ..... A41D 1/06 2/227
1,888,086 A 11/1932 Jackson
1,986,792 A 1/1935 Calvo
2,178,885 A * 11/1939 Buff ..... A43C 1/006 24/382
2,260,526 A 10/1941 Hodovan
2,285,692 A 6/1942 Wickman
2,292,227 A 8/1942 Eliezer
2,329,093 A 9/1943 Sommers et al.
2,409,601 A 10/1946 Truesdell
2,436,165 A * 2/1948 Forkish ..... A41D 11/00 2/80
2,440,752 A * 5/1948 Mathews ..... A41D 11/00 2/70
D151,885 S 11/1948 Hamilton
2,505,239 A * 4/1950 Goldstein ..... A41B 13/005 2/80
2,520,026 A 8/1950 Beitchman
2,520,300 A * 8/1950 Astrove ..... A41B 13/005 2/80
2,522,421 A * 9/1950 Wolf ..... A41B 9/08 2/80
2,586,658 A 2/1952 Helmut
2,587,450 A 2/1952 Ericsson
2,591,513 A 4/1952 Cormier
2,597,211 A * 5/1952 Weingarten ..... A41B 13/005 2/80
2,605,470 A * 8/1952 Astrove ..... A41D 13/0002 2/80
2,616,087 A * 11/1952 Werber ..... A41D 13/02 2/79
2,661,473 A * 12/1953 Miles ..... A41D 13/02 2/80
2,738,512 A * 3/1956 Winer ..... A41B 13/005 2/80
2,871,849 A 2/1959 Clark
3,110,903 A 11/1963 Burchard
3,555,567 A * 1/1971 Owen ..... A41B 13/005 2/69.5
3,763,579 A 10/1973 Dexter
3,771,169 A 11/1973 Edmund
3,789,429 A 2/1974 Garcia
4,117,609 A 10/1978 Helt
4,143,663 A 3/1979 Williams
4,145,763 A 3/1979 Abrams et al.
4,293,957 A 10/1981 Melarvie
4,384,369 A 5/1983 Prince
4,547,904 A 10/1985 Long
4,619,058 A * 10/1986 Gumbert ..... A43B 3/101 24/114.5
4,638,509 A 1/1987 Charron
4,651,353 A * 3/1987 Walden ..... A41D 1/06 2/114
4,675,918 A 6/1987 O'Brien
4,894,867 A 1/1990 Ceravolo et al.
5,002,270 A 3/1991 Shine
5,033,126 A 7/1991 Wruck et al.
5,097,535 A * 3/1992 Dye ..... A41D 10/00 2/104
5,109,546 A 5/1992 Dicker
5,157,790 A 10/1992 Aldridge
D337,194 S 7/1993 Marks
5,315,716 A * 5/1994 Baum ..... A41D 1/06 2/114
5,359,731 A 11/1994 Cavalier
5,511,245 A 4/1996 Hayes
5,560,045 A * 10/1996 Rockefeller ..... A41F 3/02 2/327
5,603,123 A * 2/1997 Chupa ..... A41D 13/129 2/275
5,611,087 A * 3/1997 Adkins ..... A41D 13/1236 2/114
5,628,064 A 5/1997 Chung
5,742,940 A * 4/1998 Sparks ..... A41D 11/00 2/227
5,802,611 A 9/1998 McKenzie et al.
5,822,793 A * 10/1998 Tokura ..... A41B 13/00 2/69
5,926,851 A * 7/1999 Kovalik ..... A41D 1/06 2/114
6,049,913 A 4/2000 Harrigan
6,178,562 B1 1/2001 Elkins
6,243,880 B1 6/2001 Lyden
6,279,161 B1 8/2001 Johnston
6,282,717 B1 9/2001 Ng
6,647,552 B1 * 11/2003 Hogan ..... A41D 13/1245 2/114
6,719,712 B2 4/2004 Zigmont
D504,202 S 4/2005 Coutant
6,959,455 B2 * 11/2005 Hall ..... A41F 19/00 2/340
7,131,147 B2 11/2006 Villegas
D567,477 S 4/2008 Smith et al.
7,454,798 B2 * 11/2008 Feodoroff ..... A41D 13/1245 2/114
7,516,499 B2 4/2009 Gardner, III
D620,230 S 7/2010 Rollins
7,832,022 B1 11/2010 Peters
7,958,571 B2 6/2011 Kitsch et al.
8,032,944 B2 10/2011 Demetropoulos
8,214,927 B1 7/2012 Jondahl et al.
8,464,365 B1 6/2013 Nunn et al.
8,510,972 B2 8/2013 Bizzo
8,578,517 B2 11/2013 Alaniz et al.
8,819,865 B1 9/2014 Crye
D746,544 S 1/2016 Curran
D756,598 S 5/2016 Pierorazio
9,999,264 B2 * 6/2018 Inzer ..... A41D 13/0015
D876,752 S * 3/2020 Francis ..... D2/742
2003/0229930 A1 12/2003 Carlson
2005/0034205 A1 2/2005 Green
2005/0166298 A1 8/2005 Pieroranzio
2006/0048262 A1 3/2006 Sencion
2006/0053658 A1 * 3/2006 Voughlohn ..... A43C 1/00 36/50.1
2007/0028362 A1 2/2007 Cash
2008/0196138 A1 8/2008 Takeuchi
2008/0235847 A1 10/2008 Alaniz et al.
2009/0088306 A1 4/2009 Alaniz et al.
2009/0178174 A1 7/2009 Cash, Jr.
2010/0299804 A1 12/2010 Huang
2011/0009793 A1 1/2011 Lucero et al.
2011/0113523 A1 5/2011 Lobas
2011/0197330 A1 8/2011 Simpson
2011/0209264 A1 9/2011 Williams et al.
2011/0219512 A1 9/2011 Davis
2011/0283436 A1 11/2011 Alaniz et al.
2012/0053553 A1 3/2012 Griggs
2012/0073028 A1 3/2012 Knopik
2012/0240312 A1 9/2012 Taylor-Barry
2012/0304361 A1 12/2012 Jeffords
2013/0254969 A1 10/2013 Getzen et al.
2013/0289512 A1 10/2013 Rhodes et al.
2014/0325734 A1 11/2014 Kuelker
2015/0128333 A1 5/2015 Atallah

(56) References Cited

U.S. PATENT DOCUMENTS

| | | | | |
|---|---|---|---|---|
| 2016/0095367 | A1* | 4/2016 | Curran | A41D 27/285<br>2/243.1 |
| 2017/0027235 | A1 | 2/2017 | Inzer | |
| 2017/0027252 | A1 | 2/2017 | Inzer | |

FOREIGN PATENT DOCUMENTS

| | | | |
|---|---|---|---|
| DE | 10203586 | A1 | 10/2003 |
| FR | 723921 | A | 4/1932 |
| FR | 1016741 | A | 11/1952 |
| FR | 2747541 | A3 | 10/1997 |
| FR | 2863456 | A1 | 6/2005 |
| FR | 2883457 | A1 | 9/2006 |
| WO | 0201976 | A1 | 1/2002 |
| WO | 2006043565 | A1 | 4/2006 |

* cited by examiner

ADJUSTABLE SUIT

CROSS-REFERENCE TO RELATED APPLICATIONS

This application is a continuation of U.S. application Ser. No. 14/809,403, filed Jul. 27, 2015 (published as U.S. Pub. No. US 2017/0027246, Feb. 2, 2017), the entire contents of which are hereby incorporated by reference.

BACKGROUND

The subject matter described herein relates to an adjustable suit worn for athletic or work activities that involve the lifting of heavy weights, and in particular embodiments, to an adjustable suit for weightlifting.

Weightlifting suits have been a staple of personal gear to increase performance during powerlifting exercises. Weightlifting suits are traditionally referred to as squat suits and deadlift suits. A squat suit is worn when performing the squat exercise. The squat, also known as the "deep knee bend," is performed by placing a barbell on the shoulders of the lifter and then squatting down and pushing back up to standing position.

A deadlift suit is worn when performing the deadlift. The deadlift is performed by grasping a barbell positioned on the floor, and pulling the barbell upward until the lifter is standing upright. Both squat suits and deadlift suits cover and support the upper portions of the legs, the buttocks, and the torso of a wearer. The suits have shoulder straps extending around both shoulders to secure the suit on the body of the lifter. Other suits are designed to provide assistance to the lifter for weightlifting competition exercises such as the snatch, clean-and-jerk, and other activities where the hips and/or torso bend during a weight-lifting movement. A similar type of weightlifting suit, known as Power Pants™ or powerlifting briefs, is commercially available. A powerlifting brief typically comprises the lower part of a squat suit without the torso portion and shoulder straps.

Squat suits, deadlift suits, powerlifting pants, and other weightlifting garments are generally made of high tensile strength fabrics such as double knit polyester, canvas, or denim, and extend tightly around the buttocks and thighs of a wearer. While such suits support and aid the wearer during lifting movements, the tautness of the fabric and snugness of the sizing makes it difficult and time consuming to don these suits compared to donning regular pants, boxer briefs, or compression shorts. Compared to other types of garments, these suits typically require the help of a second person to properly position the suit and then to pull, push, and pinch the fabric of the suit onto the lower body of the wearer. Putting on the shoulder straps also normally requires the help of a second person.

Notwithstanding the difficulties in donning such suits, they provide increased safety for the wearer during lifting activities and also supply additional support to increase the amount of weight the wearer can safely lift during a given activity. The suit fabric is taut and can withstand pressures up to several hundred pounds per square inch during the performance of a weightlifting exercise. As the wearer bends at the hips, up to several hundred pounds per square inch of pressure is placed on the suit fabric because of necessity to fit the suit tightly around the hips and legs. The pressure on the hip and leg areas of the suit in return pushes back on the hips and legs of the wearer to store energy. The stored energy is released as the wearer thrusts upward with the weight and returns to a standing position.

The body portion of traditional squat suits, deadlift suits, and power briefs is also made with openings for the legs and torso. These are the only openings which permit ingress by a wearer. To don a traditional suit, the wearer must step in through the torso opening between the shoulder straps and try to extend his legs into the leg openings. This requires a great deal of effort to wriggle, tug, pinch, and push into the suit until the crotch of the suit is near or touching the crotch of the wearer. Typically, donning such a traditional suit requires the assistance of another person.

As with the general population, weightlifters and powerlifters have differing physiques. For example, some have a large chest/torso and small hips. Others have a waist (measured circumferentially) smaller than their hips. Moreover, other weightlifter's hips and waist may be larger than the chest/torso. During fitting of a traditional suit, the wearer steps into the suit through the chest/torso area, feet first, and then pulls the suit up over each leg until the crotch of the suit is near or touches the crotch of the wearer, and the torso portion of the suit is pulled up as far as it will go on the wearer's body. Conventional suits must be large enough in the waist area for the buttocks to fit. Consequently, conventional suits are designed to be loose on the wearer's waist because the waist of the suit has to be large enough to accommodate wearers having differing combinations of hips, waist, and buttocks dimensions. Additionally, conventional suits lack the ability to adjust the tightness or looseness of the suit, either before, during, or after the suit is donned.

Therefore, a need exists for an adjustable suit for weightlifting or other activities involving lifting or thrusting motions which reduces the time and effort required to don the suit. A need also exists for a suit that accommodates wearers of different physiques by providing adjustability of the dimensions of the suit, while still providing support during athletic or work activities.

BRIEF SUMMARY

Those needs are addressed by embodiments of the invention in which at least one adjustable member is provided in the suit which increases the circumference of one or more of the waist, leg, and optional torso sections of the suit to reduce the time and effort needed to don (and take off) the suit. The adjustable features of the suit also permit the wearer to tighten one or more sections of the suit to accommodate the different physiques of wearers while providing a snug fit and support during athletic or work activities.

In accordance with one embodiment of the present invention, an adjustable suit is provided and comprises a relatively inelastic fabric which includes an optional torso section having front and back portions and a torso circumference, a waist section having a front portion and a back portion and a waist section circumference, and a leg section including a pair of legs. Each of the legs has a leg opening therein, and each of the leg openings has a leg opening circumference. In one embodiment, the suit includes at least one adjustable member. In another embodiment, the suit includes first and second adjustable members which are positioned on opposite sides of a sagittal plane of the suit and extend generally longitudinally along at least one of the (optional) torso, waist, and leg sections. The adjustable member or members are adapted to increase or decrease at least one of the (optional) torso, waist, and leg opening circumferences.

In accordance with another embodiment, an adjustable suit is provided and comprises fabric selected from the group consisting of single or multi-ply polymeric fabric and fabric from natural fibers. The adjustable suit includes a waist section having a front portion and a back portion and a waist section circumference, and a leg section including a pair of legs, each of the legs having a leg opening therein. Each of the leg openings has a leg opening circumference. The adjustable suit includes first, second, third and fourth adjustable members extending along the waist and leg sections. The first and second adjustable members are positioned on one side of a sagittal plane extending longitudinally along the waist and leg sections, and the third and fourth adjustable members are positioned on an opposite side of the sagittal plane of the suit and extend along the waist and leg sections. The second and third adjustable members comprise zippers, and the first, second, third, and fourth adjustable members are adapted to increase or decrease at least one of the waist and leg opening circumferences.

In some embodiments, the adjustable members are selected from the group consisting of laces, zippers, hook and loop fasteners, snaps, buttons, and combinations thereof. Those skilled in the art will understand that other devices and materials may be used to form the adjustable members. In some embodiments, the front and back portions of the torso section are joined together with an elastic material, and the adjustable member, such as for example laces, will overlie the elastic material. The elastic material may be in the form of a gusset and provides some degree of adjustability to the suit, while restricting the range of motion of the adjustable member.

In some embodiments, the front and back portions of the waist section are joined together with an elastic material and the adjustable member overlies the elastic material. In other embodiments, the front and back portions of the legs are joined together with an elastic material and the adjustable member overlies the elastic material. The adjustable suit may also include a crotch panel joined together with said leg sections.

In some embodiments, the adjustable suit may also include a pair of shoulder straps extending from the front portion of the waist section to the back portion of the waist section. In other embodiments, there may be a pair of shoulder straps extending from the front portion of the torso section to the back portion of the torso section. Each of the shoulder straps comprises lengths of fabric which may be releasably joined together to form a loop. The lengths of fabric may include respective fasteners to releasably secure the shoulder straps. The fasteners are preferably positioned such that the lengths of the shoulder straps are adjustable. In some embodiments, the fasteners comprise hook and loop fasteners.

In some embodiments, the first and second adjustable members extend from adjacent the top of the torso section to adjacent the bottom of the torso section. In one embodiment, the first and second adjustable members comprise zippers. In other embodiments, the adjustable members comprise laces. The laces may be made from relatively inelastic material; however, in some embodiments, the laces may be made from an elastic material which can store energy during lifting activities.

The first and second adjustable members may extend generally along opposite sides of the front portion of the torso section, or both front portion of the torso section and the waist section. The first and second adjustable members may comprise laces, zippers, hook and loop fasteners, snaps, or buttons, or combinations thereof. Those skilled in the art will understand that other devices and materials may be used to form the adjustable member.

In accordance with another embodiment of the present invention, the adjustable suit includes first, second, third, fourth, fifth, and sixth adjustable members. In this embodiment, the first and second adjustable members extend generally along opposite sides of the front portion of the torso section, and the third and fourth adjustable members extend generally along and span the front and back portions of the torso and waist sections, and the fifth and sixth adjustable members extend generally along the lengths of respective leg sections.

In yet other embodiments, alternative combinations and locations of the adjustable members are provided. For example, different sections of the suit may include more than one adjustable member. In addition, the adjustable members may be positioned in side-by-side relationship, or at angles to one another, to provide additional adjustment options for the user.

Accordingly, it is a feature of the present invention to provide at least one adjustable member in the suit which increases the circumference of one or more of the (optional) torso, waist, and leg sections of the suit to reduce the time and effort needed to don, and take off, the suit. The adjustable features of the suit also permit the wearer to tighten one or more sections of the suit to accommodate the different physiques of wearers while providing support during athletic or work activities. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention are presented by way of example and can be best understood when read in conjunction with the following drawings, where like structure is indicated with like reference numerals and in which.

DETAILED DESCRIPTION

Figure 1:
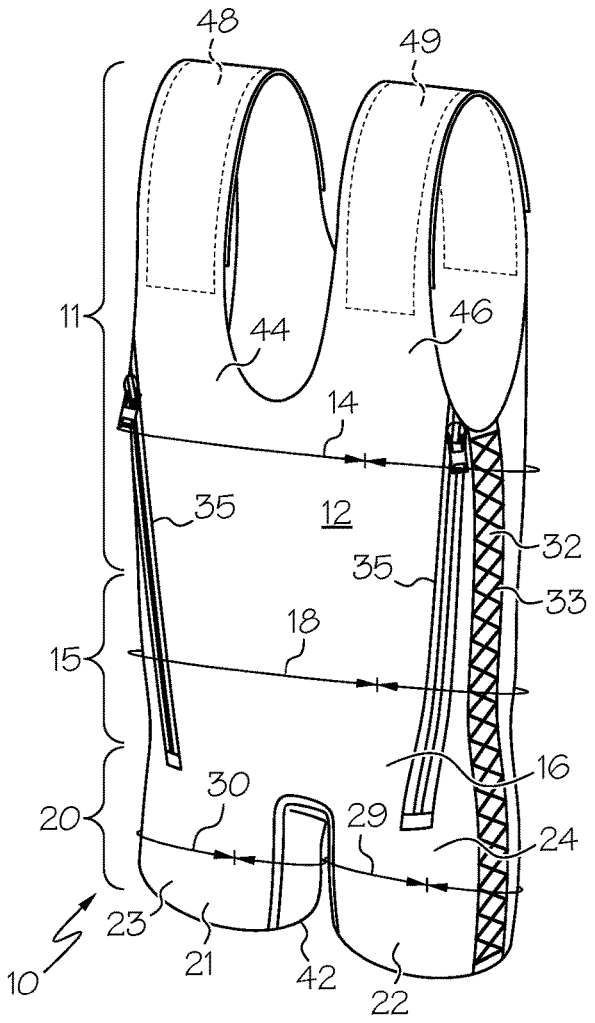
FIG. 1 is a perspective view of one embodiment of the adjustable suit.
Figure 2:
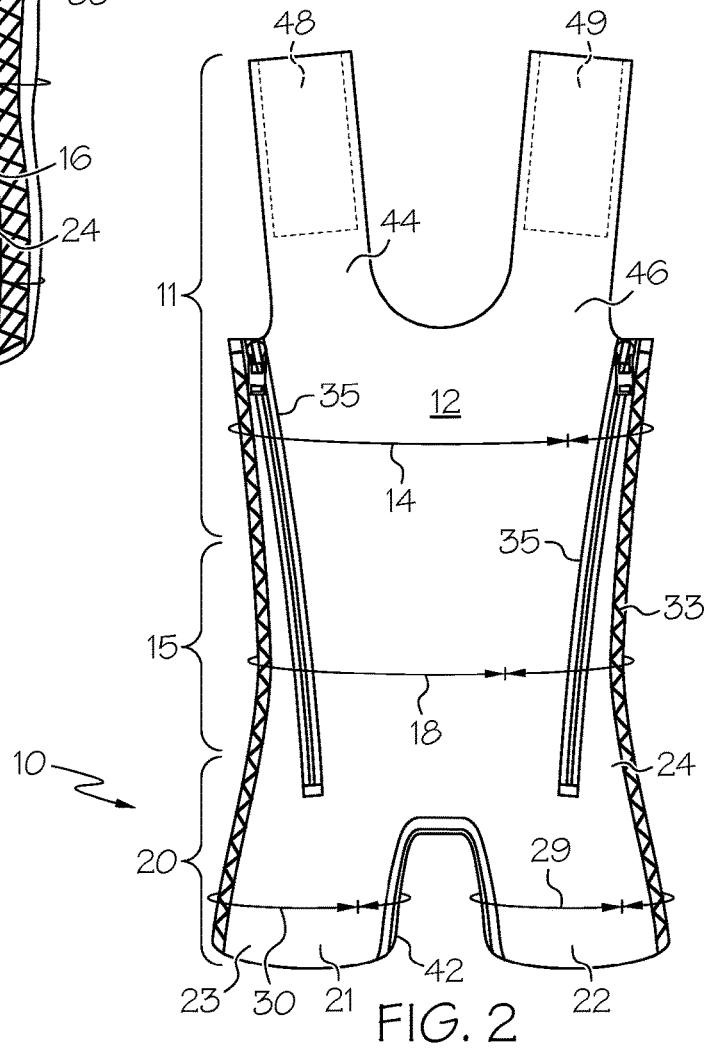
FIG. 2 is a front view of the adjustable suit of FIG. 1.
Figure 3:
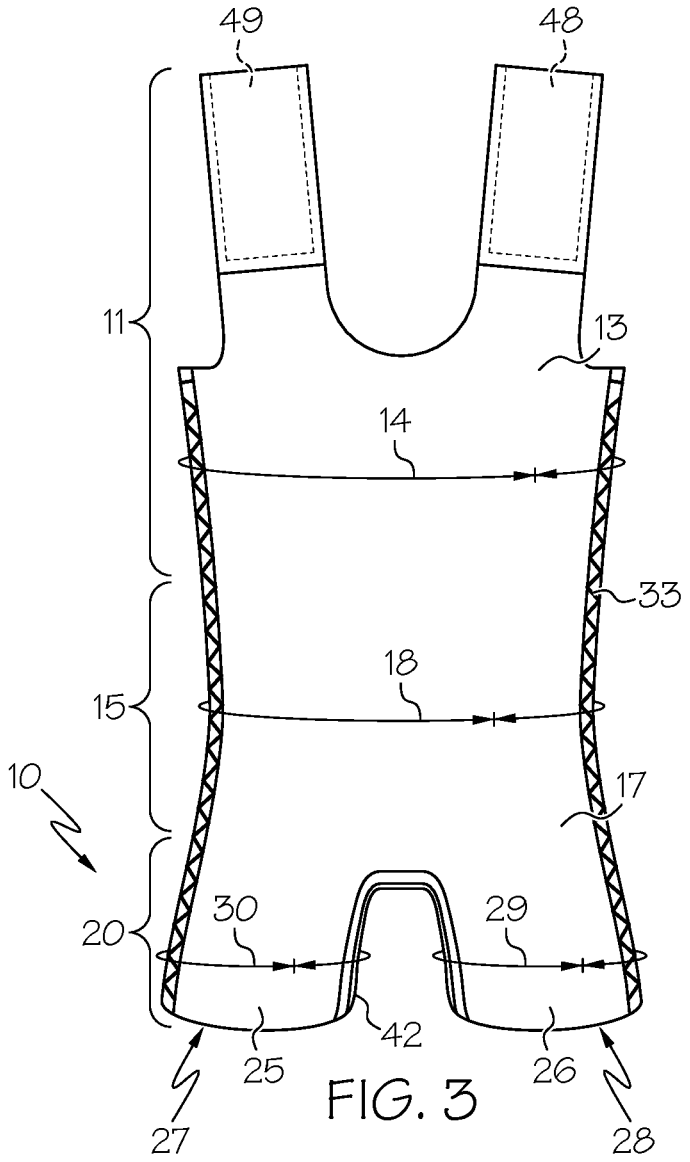
FIG. 3 is a rear view of the adjustable suit of FIG. 1.
Figure 4:
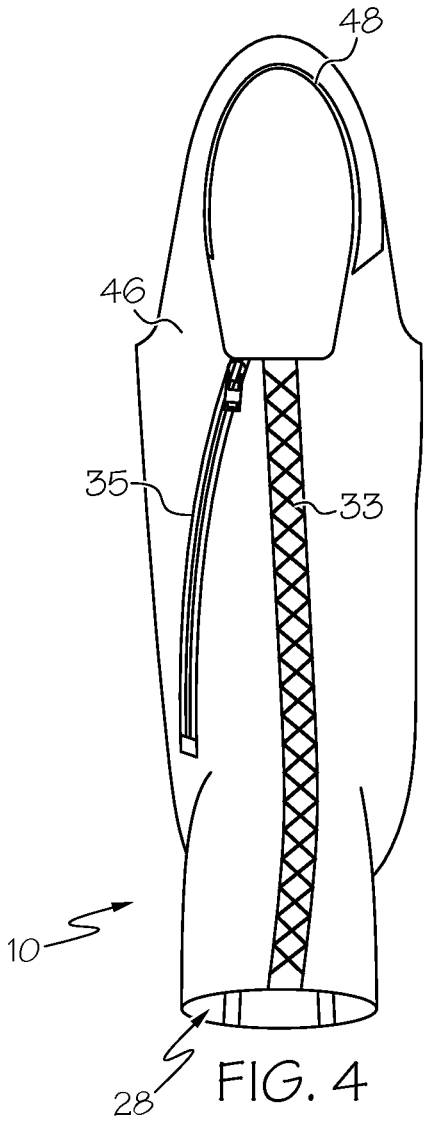
FIG. 4 is a side view of the adjustable suit of FIG. 1.

Referring initially to a first embodiment illustrated in FIGS. 1-8, an adjustable suit 10 is shown which includes a torso section generally indicated at 11, a waist section generally indicated at 15, and a leg section generally indicated at 20. Torso section 11 is optional, and the suit may include just the waist and leg sections. The suit 10 is preferably made from a high tensile strength (e.g., 90 psi or greater), relatively inelastic material such as single or multiply polymeric fabric including polyester or nylon, and natural fibers including cotton (such as, for example, canvas or denim). By "relatively inelastic" it is meant that the fabric does not noticeably stretch when subjected to the stresses and strains associated with its use in a variety of lifting activities. The material forming suit 10 may comprise a solid sheet of material, or may be of woven fabric.

Torso section 11 includes a front portion 12 and a back portion 13. The suit provides a torso circumference 14. Waist section 15 includes a front portion 16 and a back portion 17. The suit provides a waist section circumference 18. Leg section 20 includes a pair of legs 21, 22, each having respective leg openings 27, 28, having respective leg opening circumferences 29, 30, and with each leg having respective front 23, 24 and back 25, 26 portions. A crotch panel 42 provides support to the wearer. Sections of the adjustable suit may be fabricated from a unitary piece of fabric, or may be fabricated from pieces of fabric stitched or otherwise bonded or adhered together.

Figure 5:
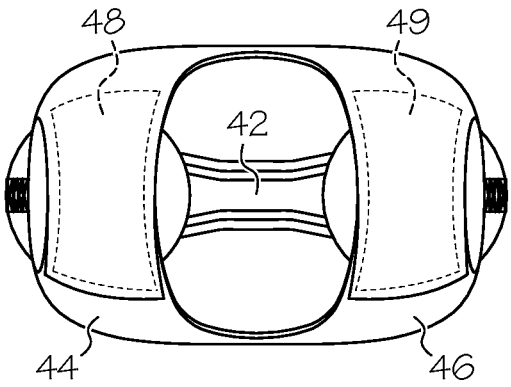
FIG. 5 is a top view of the adjustable suit of FIG. 1.
Figure 8:
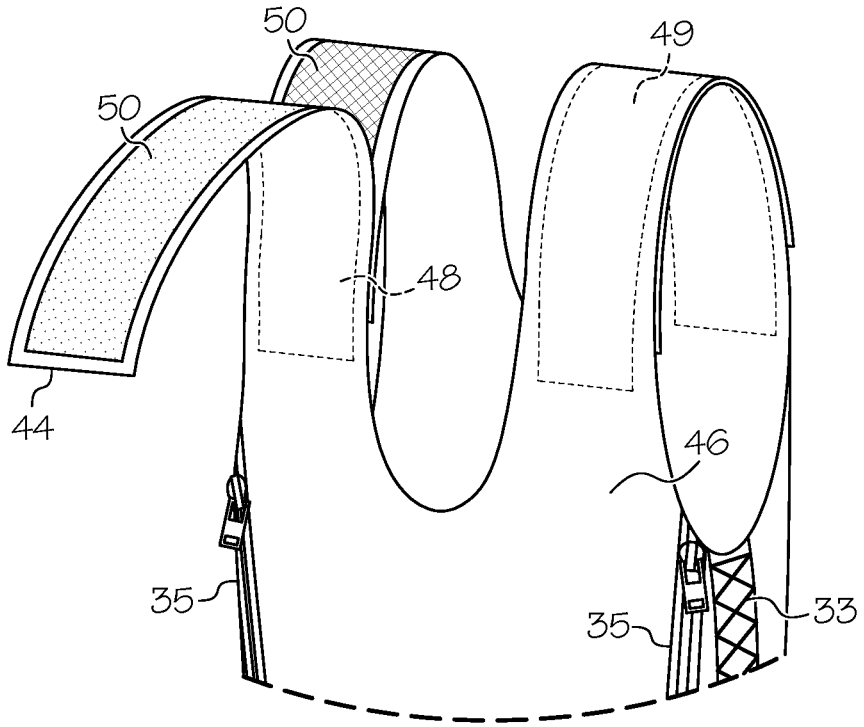
FIG. 8 is a perspective view of the adjustable suit of FIG. 1 illustrating the adjustable shoulder straps.

In the illustrated embodiment, adjustable suit 10 also includes a pair of shoulder straps 44, 46. It will be apparent to those skilled in this art that suit 10 may also include sleeves (not shown) if the suit is fabricated to include an opening in the back of the torso section. As best shown in FIGS. 5 and 8, the shoulder straps comprise lengths of fabric or other suitable high tensile strength material and are adjustable through the use of fasteners 48, 49. As shown, the fasteners comprise hook and loop fasteners 50. By making the shoulder straps adjustable, suit 10 is easier to don, and the tightness of the shoulder straps can be adjusted to fit different physiques of the wearers. In other embodiments (not shown), the torso section may be eliminated, and the shoulder straps will extend from the front portion of the waist section over the shoulders of a wearer to the back portion of the waist section.

Figure 7A:
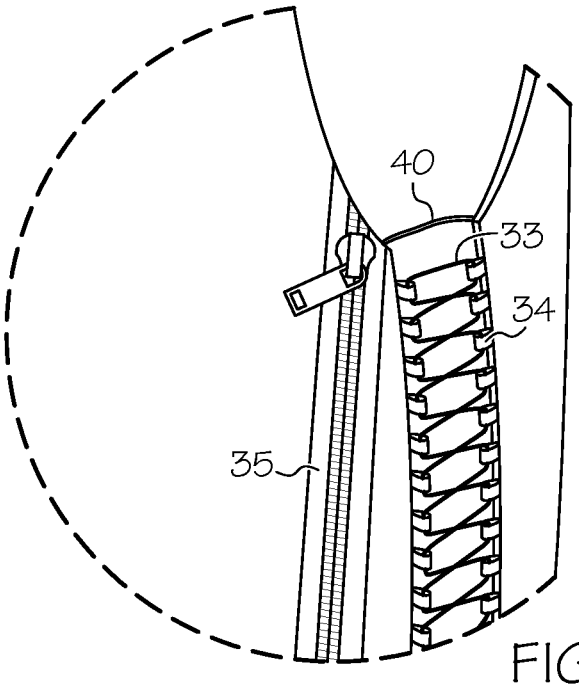
FIG. 7A is an enlarged view of the zipper and laces in the torso section of the adjustable suit of FIG. 1.
Figure 7B:
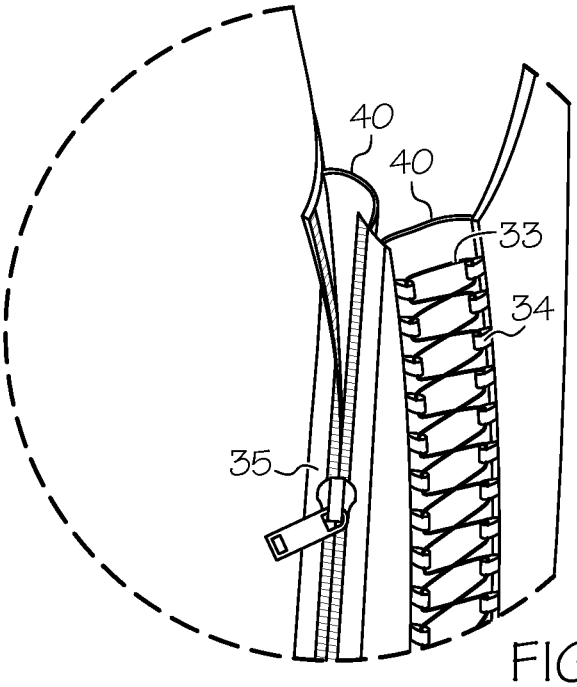
FIG. 7B is an enlarged view of the zipper, partially unzipped, elastic material behind the zipper, and laces in the torso section of the adjustable suit of FIG. 1.

To aid in making it easier for a wearer to put on and take off the suit, adjustable suit 10 includes first and second adjustable members 32 which are positioned on opposite sides of a sagittal plane of the suit and which are adapted to increase or decrease at least one of the (optional) torso, waist, and leg opening circumferences. The adjustable members may comprise laces 33, zippers 35, hook and loop fasteners 36, snaps 37, buttons 38, or any other suitable means which provides the capability of adjusting the circumference of one or more sections of the suit. The materials used in the adjustable member are selected so that the adjustable member has a tensile strength that is able to withstand the stresses and strains placed on the suit during a variety of lifting activities. Typically, the materials are selected to be able to withstand stresses of up to several hundred pounds. To provide further adjustability, and as best shown in FIGS. 7A and 7B, one or more of the respective front and back portions of one or more of the (optional) torso, waist, and leg sections of the suit are joined together with an elastic material 40. In this embodiment, elastic material 40 forms a gusset and may comprise a fabric woven to provide some degree of stretch when pulled. The elastic material may comprise an elastomer such as Neoprene® rubber. Alternatively, the elastic material may comprise a fabric having an elastomeric material woven therein such as a Lycra® or Spandex® fabric. Elastic material 40 may be sewn to or otherwise bonded to the respective front and back portions 12, 13 of, for example, torso section 11 or waist section 15.

In the embodiment illustrated, there are four adjustable members, two zippers 35 and two sets of laces 33. Laces 33 extend substantially along the length of the torso, waist, and leg sections of the suit, adjustably joining together respective front and back portions of the torso, waist, and leg sections of the suit. The laces may comprise any suitable length of material which will withstand the stresses and strains of supporting the wearer. The laces may be made of woven fabric or of a solid length of material, and may include a reinforcing core. For example, there are several grades of paracord (parachute cord) that are commercially available which are suitable for use as laces. Generally, paracord is fabricated from a lightweight, braided material such as nylon, cotton, polyester, or polypropylene which is woven around a core material. Paracord is relatively inelastic. Alternatively, one can use an elastic cord such as cord material commonly-known as Bungee cord. Typically, Bungee cord includes a lightweight braided exterior layer woven around a core of natural or synthetic rubber. Such elastic cord material will stretch when placed under sufficient strain. When engaging in lifting activities, the laces will stretch and store energy which is then released to aid the lifter.

Figure 6:
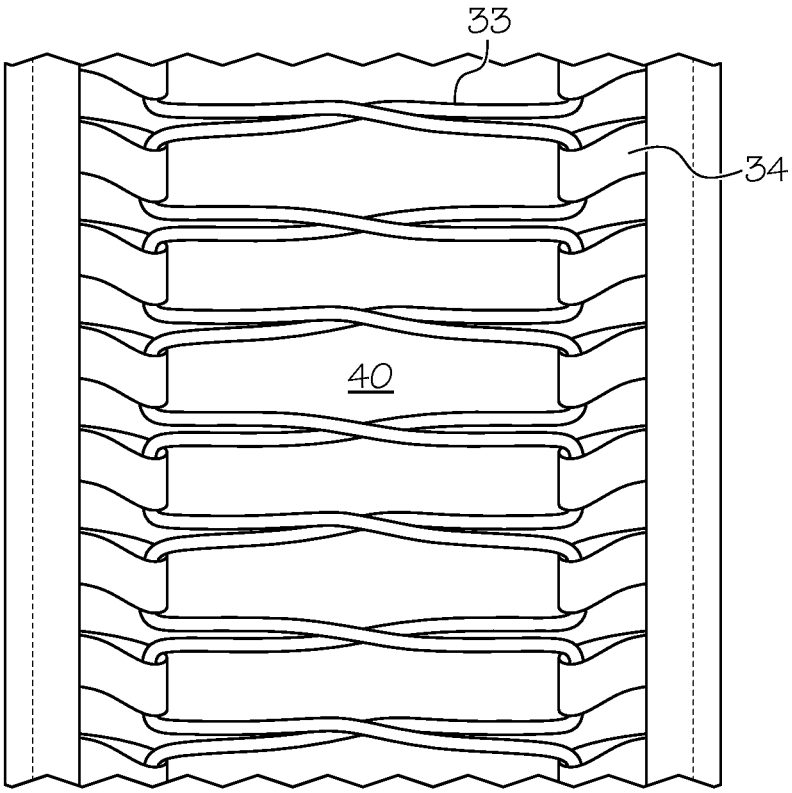
FIG. 6 is an enlarged side view, in section, of the arrangement of the laces of the adjustable suit of FIG. 1.

As best seen in FIG. 6, laces 33 are laced in a criss-cross fashion through fabric loops 34 and then may be tightened and tied off as is conventional. While loops are shown, it will be apparent to those skilled in the art that eyelets or other holes, openings, or perforations may be utilized. When loosened, the laces, and elastic material 40, permit the circumferences of the torso, waist, and leg sections of suit 10 to increase so that a user may more easily don the suit. Once in the suit, the wearer can tighten the laces to create a snug fit.

Similarly, zippers 35 extend substantially along the length of the front portions of the torso and waist sections of the suit. As shown, the zippers may be angled from a generally vertical orientation. Typically, the zippers are angled at between about 10 to about 30° from vertical. As with the laces, when zippers 35 are unzipped, the torso and waist section circumferences of the suit increase so that a user may more easily don the suit. The zippers can then be zipped to a closed position to provide a snug fit for the wearer.

Figure 29:
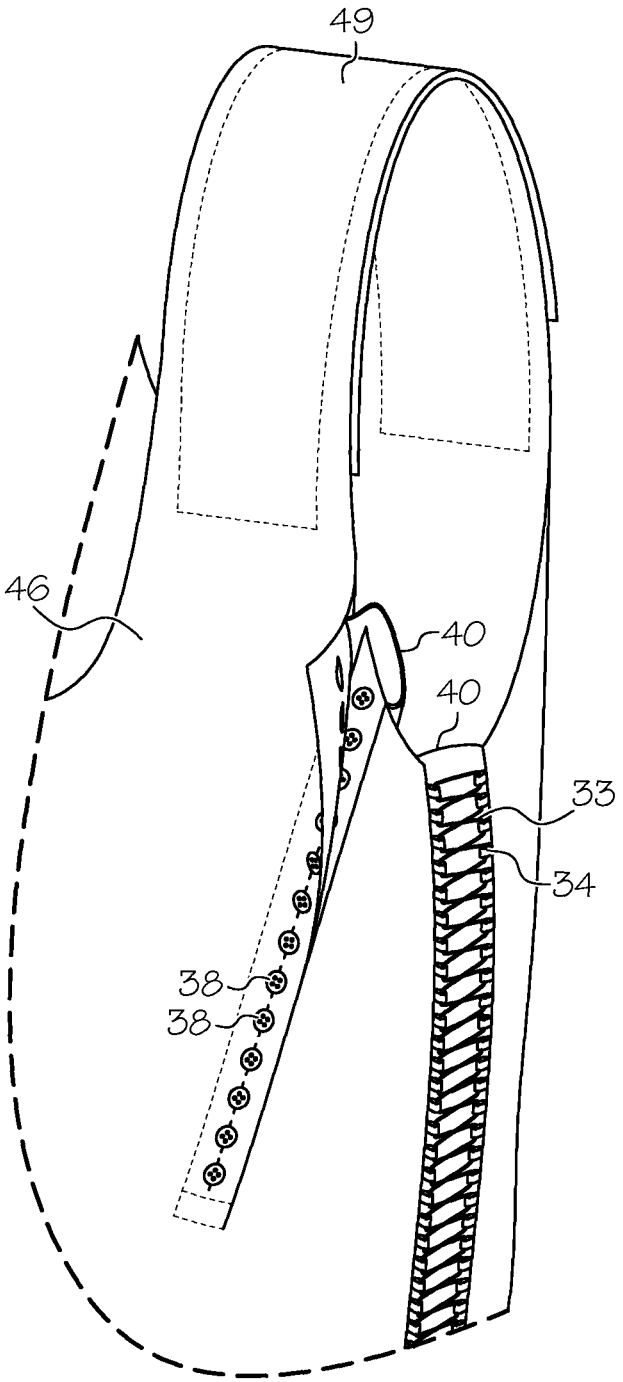
FIG. 29 is an enlarged section showing detail for an alternative embodiment of the adjustable suit.
Figure 30:
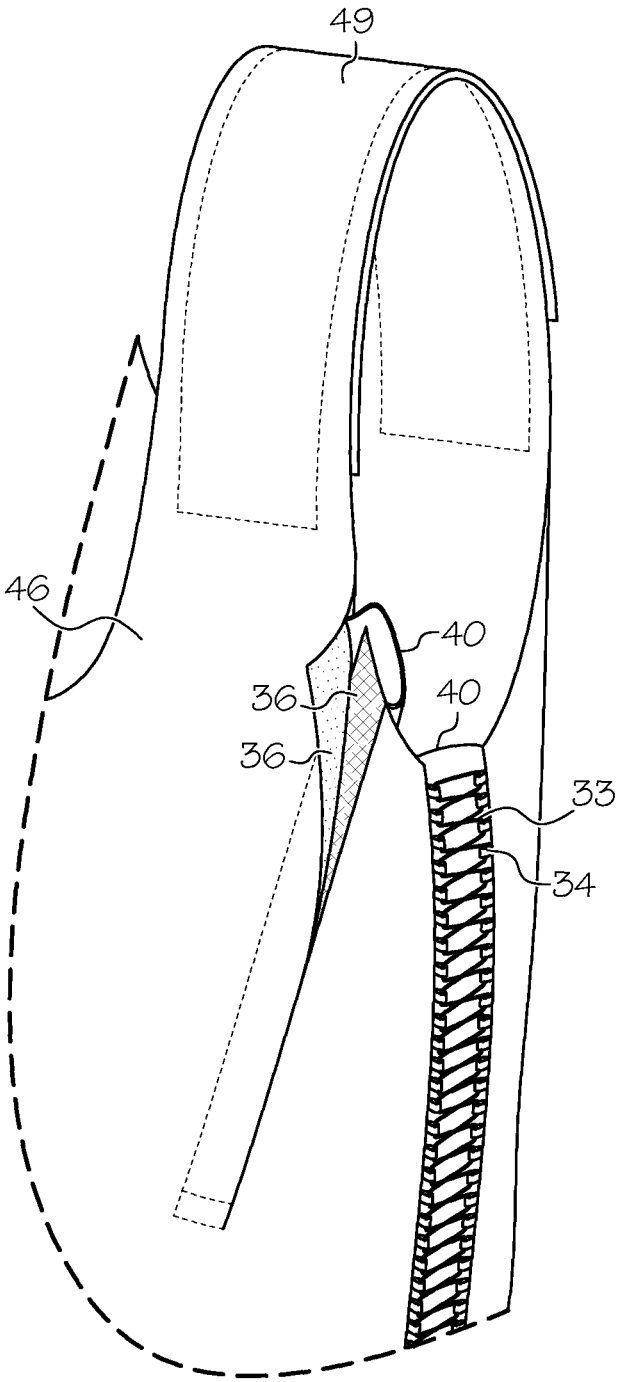
FIG. 30 is an enlarged section showing detail for an alternative embodiment of the adjustable suit.
Figure 31:
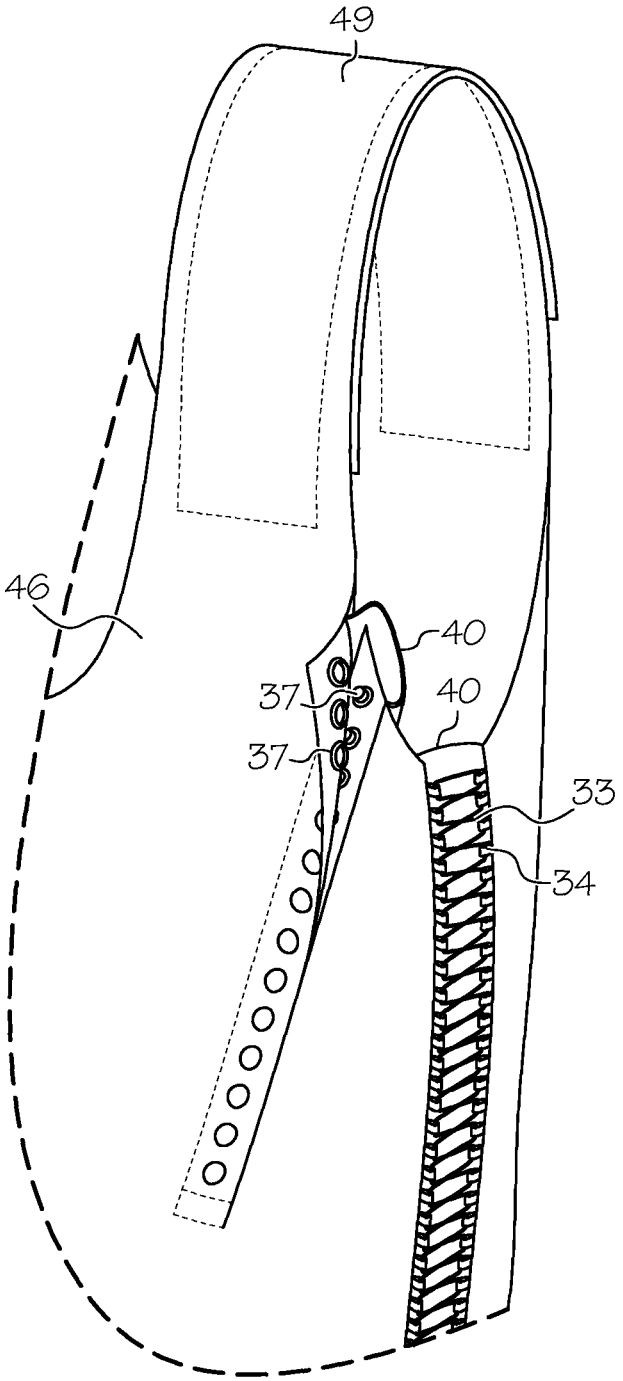
FIG. 31 is an enlarged section showing detail for an alternative embodiment of the adjustable suit.

Alternatively, laces 33 or zippers 35 may be replaced by buttons 38 (see, FIG. 29), hook and loop fasteners 36 (see FIG. 30), or snaps 37 (see FIG. 31). In each alternative embodiment, unbuttoning the buttons, separating the hook and loop fasteners, or unsnapping the snaps allows the circumferences of the (optional) torso and waist sections of the suit to increase, making it easier for a user to don the suit. Generally, all of these adjustable members are interchangeable, and different combinations of any of them may be utilized.

Referring now to FIGS. 9-13, another embodiment of the adjustable suit is illustrated. As shown, an adjustable suit 110 is shown which includes a torso section generally indicated at 111, a waist section generally indicated at 115, and a leg section generally indicated at 120. As in previous embodiments, the suit 110 is preferably made from a high tensile strength (e.g., 90 psi or greater), relatively inelastic material such as single or multi-ply polymeric fabric including polyester or nylon, and natural fibers including cotton (such as, for example, canvas or denim).

Torso section 111 includes a front portion 112 and a back portion 113. The suit provides a torso circumference 114. Waist section 115 includes a front portion 116 and a back portion 117. The suit provides a waist section circumference 118. Leg section 120 includes a pair of legs 121, 122, each having respective leg openings 127, 128, and leg opening circumferences 129, 130, and with each leg having respective front 123, 124 and back 125, 126 portions. A crotch panel 142 provides support to the wearer. Sections of the adjustable suit may be fabricated from a unitary piece of fabric, or may be fabricated from pieces of fabric stitched or otherwise bonded or adhered together.

Figure 9:
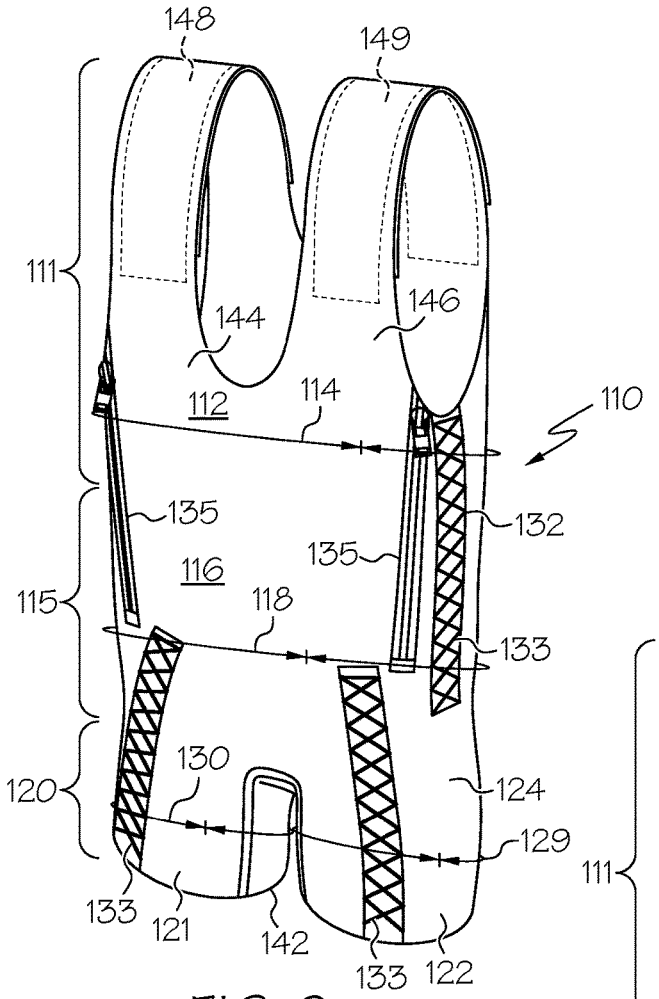
FIG. 9 is a perspective view of an alternative embodiment of the adjustable suit.
Figure 10:
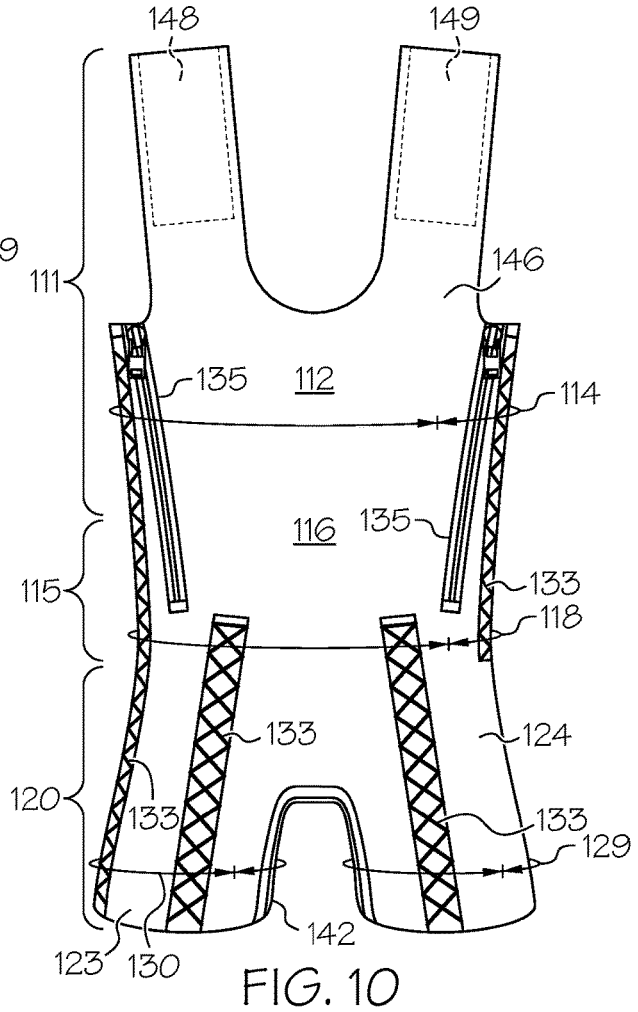
FIG. 10 is a front view of the adjustable suit of FIG. 9.
Figure 11:
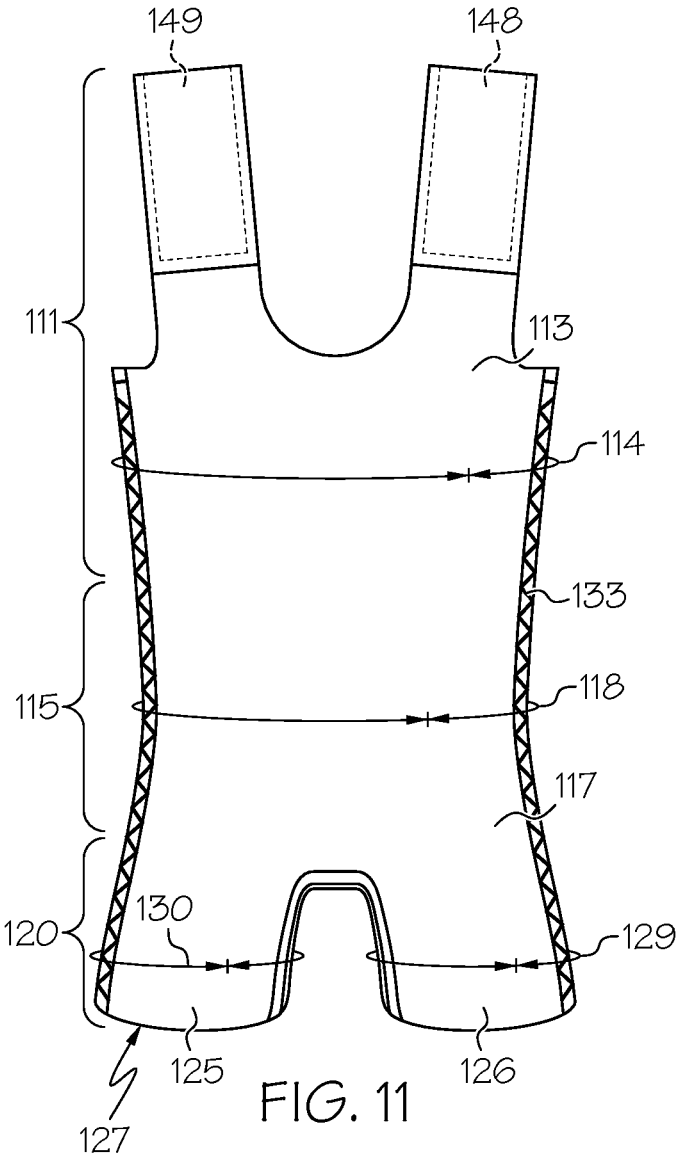
FIG. 11 is a back view of the adjustable suit of FIG. 9.
Figure 12:
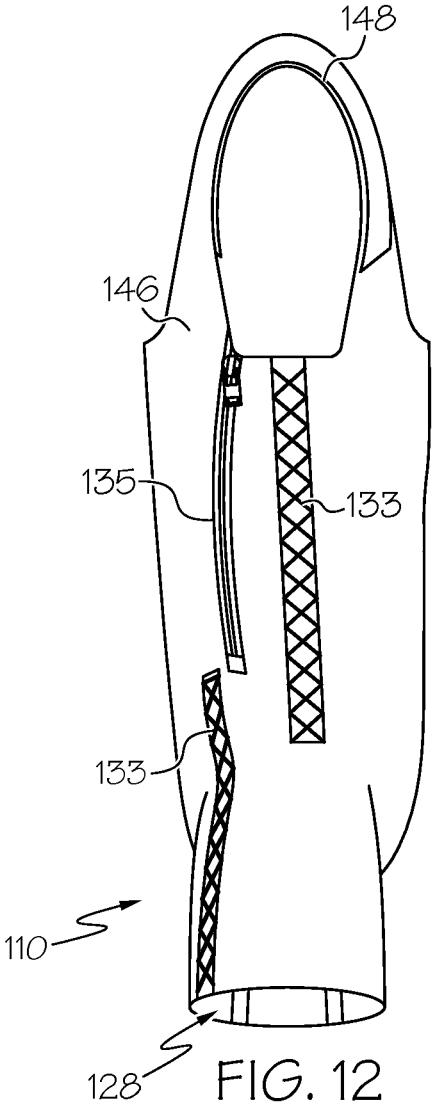
FIG. 12 is a side view of the adjustable suit of FIG. 9.
Figure 13:
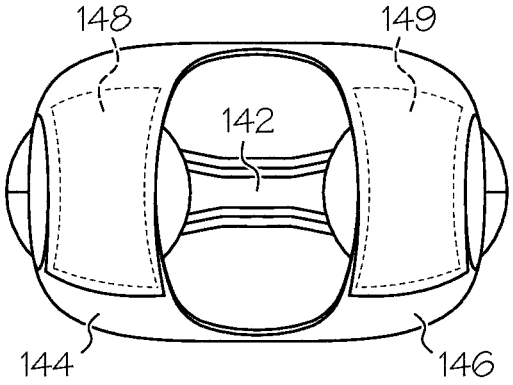
FIG. 13 is a top view of the adjustable suit of FIG. 9.

Adjustable suit 110 also includes a pair of shoulder straps 144, 146. It will be apparent to those skilled in this art that suit 110 may also include sleeves (not shown) if the suit is fabricated to include an opening in the back of the torso section. As best shown in FIGS. 9 and 10, the shoulder straps comprise lengths of fabric or other suitable high tensile strength material and are adjustable through the use of fasteners 148, 149. By making the shoulder straps adjustable, suit 110 is easier to don, and the tightness of the shoulder straps can be adjusted to fit different physiques of the wearers.

To aid in making it easier for a wearer to put on and take off the suit, adjustable suit 110 includes adjustable members 132 which are adapted to increase or decrease at least one of the (optional) torso, waist, and leg opening circumferences. The adjustable members may comprise laces 133, zippers 135, hook and loop fasteners, snaps, buttons, or any other suitable means which provides the capability of adjusting the circumference of one or more sections of the suit. To provide further adjustability, one or more of the respective front and back portions of one or more of the torso, waist, and leg sections of the suit may be joined together with an elastic material (not shown; see FIGS. 7A and 7B of previous embodiment). The elastic material may be sewn to or otherwise bonded to the respective front and back portions 112, 113 of, for example, torso section 111 or waist section 115.

In the embodiment illustrated in FIGS. 9-13, there are six adjustable members, two zippers 135 and two sets of laces 133. A first pair of laces 133 extends substantially along the length of the torso section of the suit, adjustably joining together respective front and back portions of the torso and waist sections of the suit. A second pair of laces 133 extends substantially vertically downwardly along opposing front and back portions of the waist section. The laces may comprise any suitable length of material which will withstand the stresses and strains of supporting the wearer.

As in previous embodiments, laces 133 are laced in a criss-cross fashion through fabric loops (not shown) and then may be tightened and tied off as is conventional. It will be apparent to those skilled in the art that eyelets or other holes, openings, or perforations may be utilized. When loosened, the laces, and elastic material, permit the circumferences of the torso, waist, and leg sections of suit 110 to increase so that a user may more easily don the suit. Once in the suit, the wearer can tighten the laces to create a snug fit.

Similarly, zippers 135 extend substantially along the length of the front portions of the torso section 115 of the suit. As shown, the zippers may be angled from a generally vertical orientation. Typically, the zippers are angled at between about 10 to about 30° from vertical. As with the laces, when zippers 135 are unzipped, the torso section circumference of the suit increases so that a user may more easily don the suit. The zippers can then be zipped to a closed position to provide a snug fit for the wearer.

As in previous embodiments, laces 133 or zippers 135 may be replaced by buttons. hook and loop fasteners, or snaps. In each alternative embodiment, unbuttoning the buttons, separating the hook and loop fasteners, or unsnapping the snaps allows the circumferences of the torso, waist, and/or leg sections of the suit to increase, making it easier for a user to don the suit. Generally, all of these adjustable members are interchangeable, and different combinations of any of them may be utilized.

Referring now to FIGS. 14-18, yet another embodiment of the adjustable suit is illustrated. As shown, an adjustable suit 210 is shown which includes a torso section generally indicated at 211, a waist section generally indicated at 215, and a leg section generally indicated at 220. As in previous embodiments, the suit 210 is preferably made from a high tensile strength (e.g., 90 psi or greater), relatively inelastic material such as single or multi-ply polymeric fabric including polyester or nylon, and natural fibers including cotton (such as, for example, canvas or denim).

Torso section 211 includes a front portion 212 and a back portion 213. The suit provides a torso circumference 214. Waist section 215 includes a front portion 216 and a back portion 217. The suit provides a waist section circumference 218. Leg section 220 includes a pair of legs 221, 222, each having respective leg openings 227, 228, and respective leg opening circumferences 229, 230 and with each leg having respective front 223, 224 and back 225, 226 portions. A crotch panel 242 provides support to the wearer. Sections of the adjustable suit may be fabricated from a unitary piece of fabric, or may be fabricated from pieces of fabric stitched or otherwise bonded or adhered together.

Figure 14:
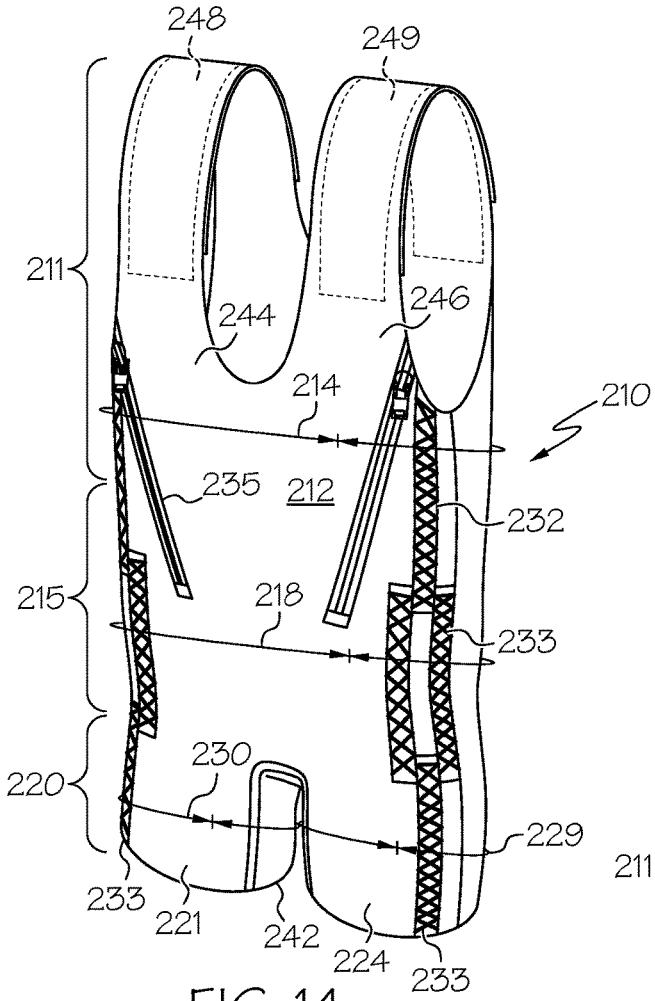
FIG. 14 is a perspective view of another embodiment of the adjustable suit.
Figure 15:
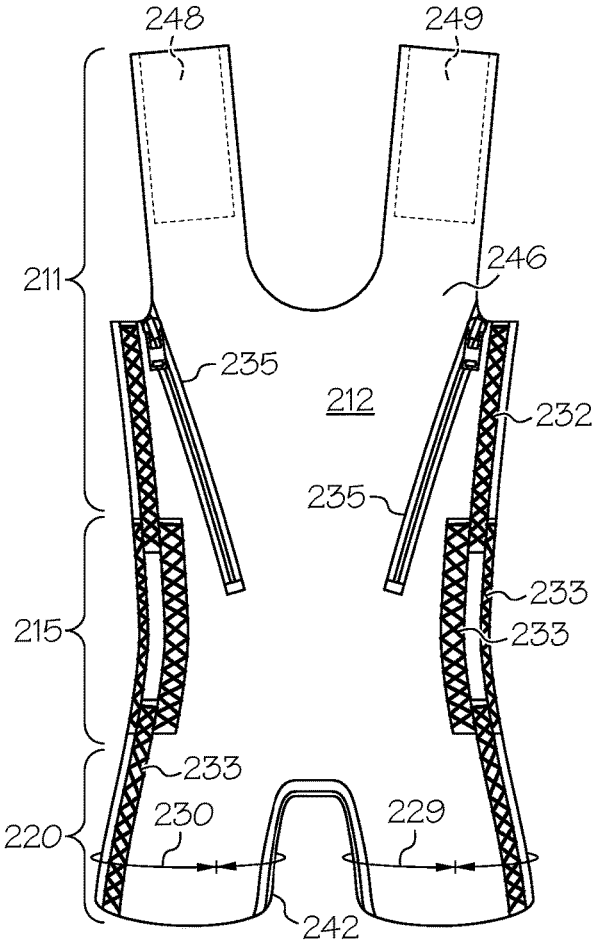
FIG. 15 is a front view of the adjustable suit of FIG. 14.
Figure 16:
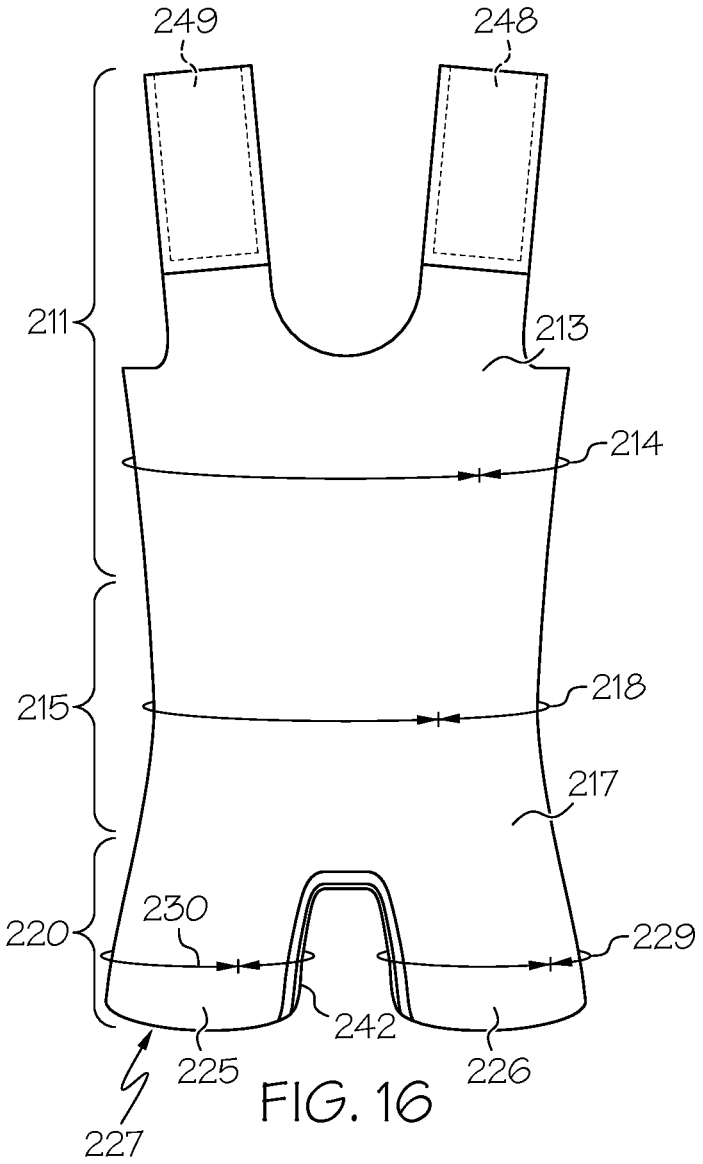
FIG. 16 is a back view of the adjustable suit of FIG. 14.
Figure 17:
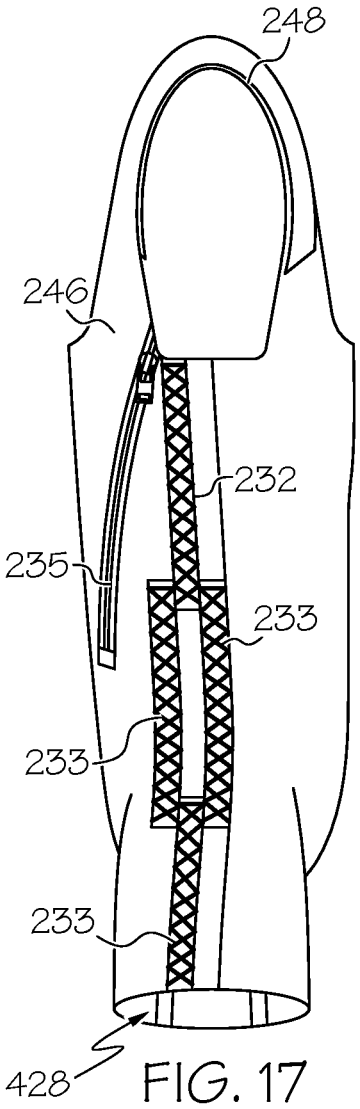
FIG. 17 is a side view of the adjustable suit of FIG. 14.
Figure 18:
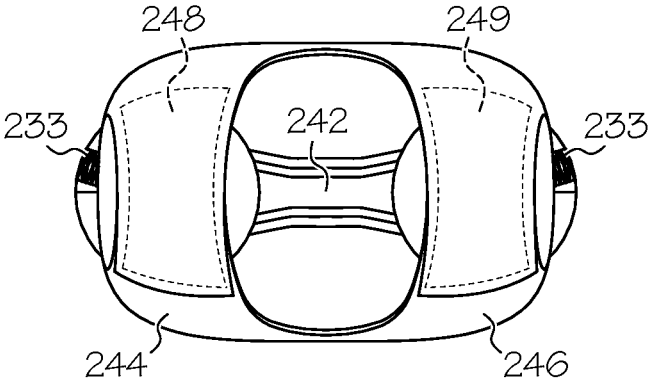
FIG. 18 is a top view of the adjustable suit of FIG. 14.

Adjustable suit 210 also includes a pair of shoulder straps 244, 246. It will be apparent to those skilled in this art that suit 210 may also include sleeves (not shown) if the suit is fabricated to include an opening in the back of the torso section. As best shown in FIGS. 14 and 15, the shoulder straps comprise lengths of fabric or other suitable high tensile strength material and are adjustable through the use of fasteners 248, 249. By making the shoulder straps adjustable, suit 210 is easier to don, and the tightness of the shoulder straps can be adjusted to fit different physiques of the wearers.

To aid in making it easier for a wearer to put on and take off the suit, adjustable suit 210 includes adjustable members 232 which are adapted to increase or decrease at least one of the (optional) torso, waist, and leg opening circumferences. The adjustable members may comprise laces 233, zippers 235, hook and loop fasteners, snaps, buttons, or any other suitable means which provides the capability of adjusting the circumference of one or more sections of the suit. To provide further adjustability, one or more of the respective front and back portions of one or more of the torso, waist, and leg sections of the suit may be joined together with an elastic material (not shown; see FIGS. 7A and 7B of previous embodiment). The elastic material may be sewn to or otherwise bonded to the respective front and back portions 212, 213 of, for example, torso section 211 or waist section 215.

In the embodiment illustrated in FIGS. 14-18, there are ten adjustable members, two zippers 235 and eight sets of laces 233. A first pair of laces 233 extends substantially along the length of the torso section of the suit, adjustably joining together respective front and back portions of the torso and waist sections of the suit. Second and third pairs of laces 233 extend substantially vertically downwardly along opposing front and back portions of the waist section. And, fourth pair of laces 233 extends generally vertically downwardly substantially along the length of leg section 220. The laces may comprise any suitable length of material which will withstand the stresses and strains of supporting the wearer.

As in previous embodiments, laces 233 are laced in a criss-cross fashion through fabric loops (not shown) and then may be tightened and tied off as is conventional. It will be apparent to those skilled in the art that eyelets or other holes, openings, or perforations may be utilized. When loosened, the laces, and elastic material, permit the circumferences of the torso, waist, and leg sections of suit 210 to increase so that a user may more easily don the suit. Once in the suit, the wearer can tighten the laces to create a snug fit.

Similarly, zippers 235 extend substantially along the length of the front portions of the torso section 215 of the suit. As shown, the zippers may be angled from a generally vertical orientation. Typically, the zippers are angled at between about 10 to about 30° from vertical. As with the laces, when zippers 235 are unzipped, the torso section circumference of the suit increases so that a user may more easily don the suit. The zippers can then be zipped to a closed position to provide a snug fit for the wearer.

As in previous embodiments, laces 233 or zippers 235 may be replaced by buttons. hook and loop fasteners, or snaps. In each alternative embodiment, unbuttoning the buttons, separating the hook and loop fasteners, or unsnapping the snaps allows the circumferences of the torso, waist, and/or leg sections of the suit to increase, making it easier for a user to don the suit. Generally, all of these adjustable members are interchangeable, and different combinations of any of them may be utilized.

Referring now to FIGS. 19-23, yet another embodiment of the adjustable suit is illustrated. As shown, an adjustable suit 310 is shown which includes a torso section generally indicated at 311, a waist section generally indicated at 315, and a leg section generally indicated at 320. As in previous embodiments, the suit 310 is preferably made from a high tensile strength (e.g., 90 psi or greater), relatively inelastic material such as single or multi-ply polymeric fabric including polyester or nylon, and natural fibers including cotton (such as, for example, canvas or denim).

Torso section 311 includes a front portion 312 and a back portion 313. The suit provides a torso circumference 314. Waist section 315 includes a front portion 316 and a back portion 317. The suit provides a waist section circumference 318. Leg section 320 includes a pair of legs 321, 322, each having respective leg openings 327, 328, with respective leg opening circumferences 329, 330 and with each leg having respective front 323, 324 and back 325, 326 portions. A crotch panel 342 provides support to the wearer. Sections of the adjustable suit may be fabricated from a unitary piece of fabric, or may be fabricated from pieces of fabric stitched or otherwise bonded or adhered together.

Figure 19:
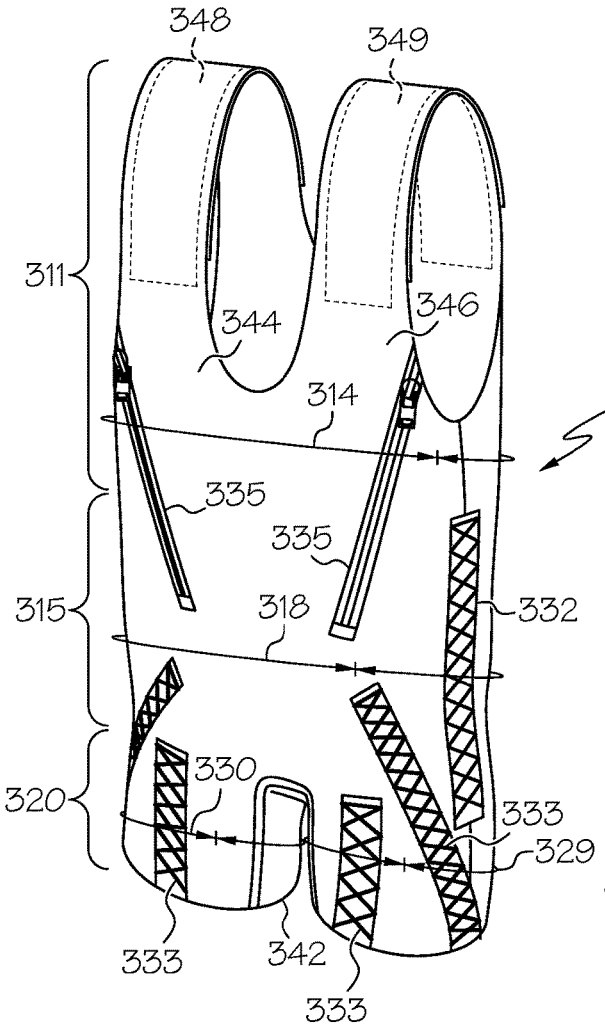
FIG. 19 is a perspective view of yet another embodiment of the adjustable suit.
Figure 20:
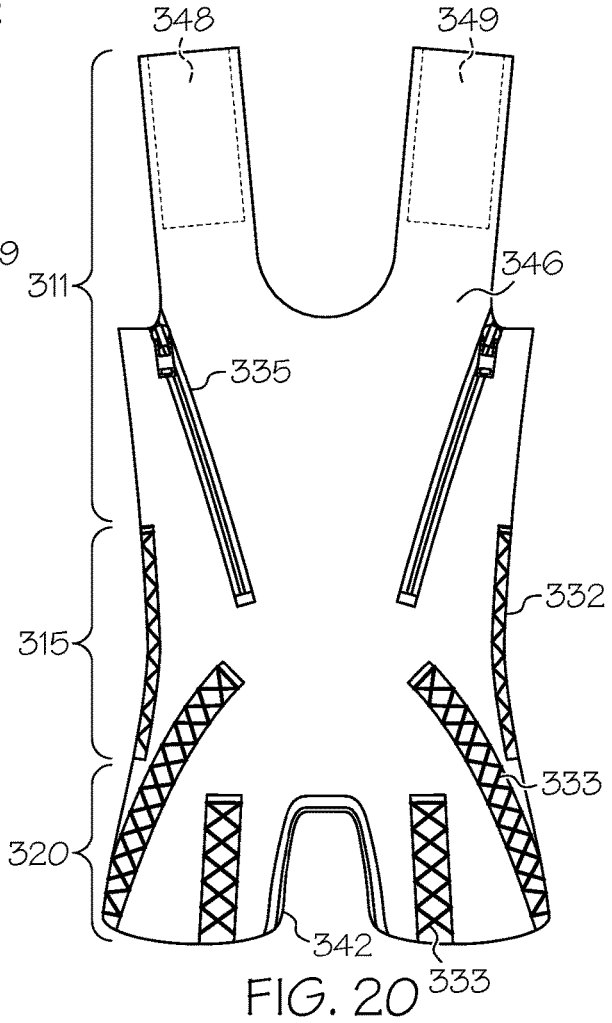
FIG. 20 is a front view of the adjustable suit of FIG. 19.
Figure 21:
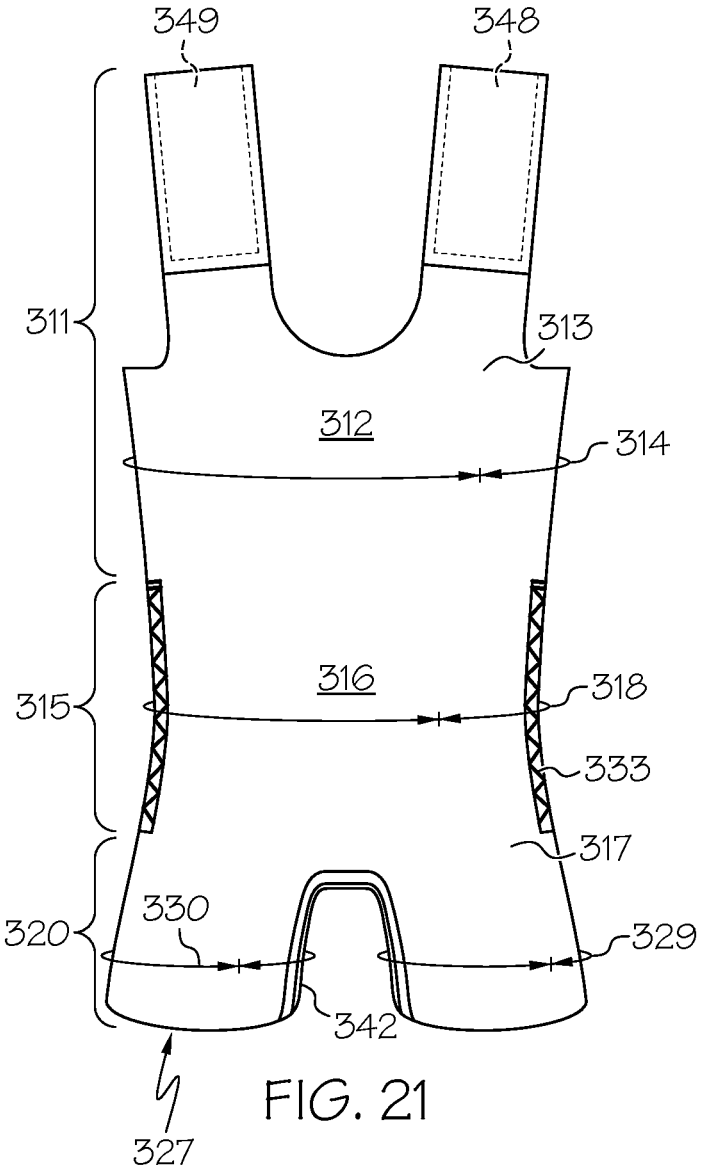
FIG. 21 is a rear view of the adjustable suit of FIG. 19.
Figure 22:
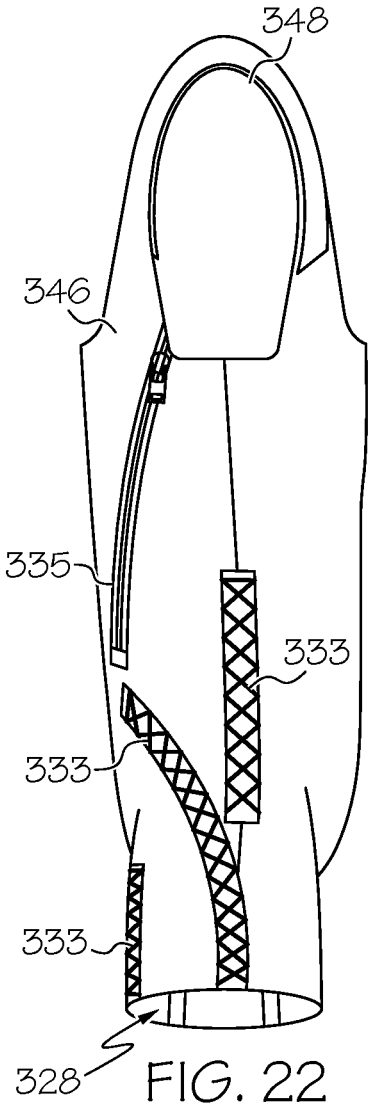
FIG. 22 is a side view of the adjustable suit of FIG. 19.
Figure 23:
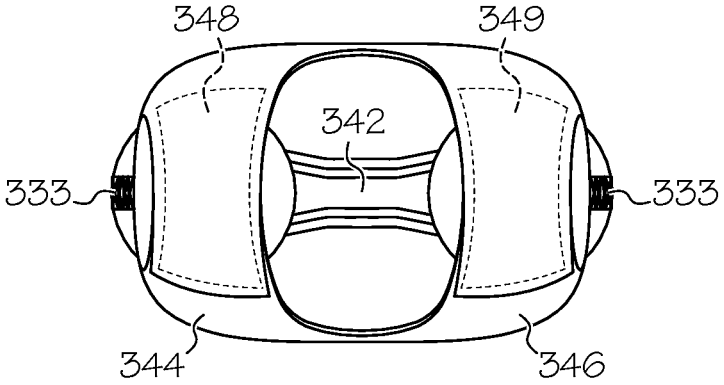
FIG. 23 is a top view of the adjustable suit of FIG. 19.

Adjustable suit 310 also includes a pair of shoulder straps 344, 346. It will be apparent to those skilled in this art that suit 310 may also include sleeves (not shown) if the suit is fabricated to include an opening in the back of the torso section. As best shown in FIGS. 19 and 20, the shoulder straps comprise lengths of fabric or other suitable high tensile strength material and are adjustable through the use of fasteners 348, 349. By making the shoulder straps adjustable, suit 310 is easier to don, and the tightness of the shoulder straps can be adjusted to fit different physiques of the wearers.

To aid in making it easier for a wearer to put on and take off the suit, adjustable suit 310 includes adjustable members 332 which are adapted to increase or decrease at least one of the (optional) torso, waist, and leg opening circumferences. The adjustable members may comprise laces 333, zippers 335, hook and loop fasteners, snaps, buttons, or any other suitable means which provides the capability of adjusting the circumference of one or more sections of the suit. To provide further adjustability, one or more of the respective front and back portions of one or more of the torso, waist, and leg sections of the suit may be joined together with an elastic material (not shown; see FIGS. 7A and 7B of previous embodiment). The elastic material may be sewn to or otherwise bonded to the respective front and back portions 312, 313 of, for example, torso section 311.

In the embodiment illustrated in FIGS. 19-23, there are eight adjustable members, two zippers 335 and six sets of laces 333. A first pair of laces 333 extends partially along the length of the torso and waist sections of the suit, adjustably joining together respective front and back portions of the torso and waist sections of the suit. A second pair of laces 333 extends substantially angled downwardly across the front portion of the waist section. And, a third pair of laces 333 extend generally vertically downwardly substantially along the length of the front portions of the legs 321, 322. The laces may comprise any suitable length of material which will withstand the stresses and strains of supporting the wearer.

As in previous embodiments, laces 333 are laced in a criss-cross fashion through fabric loops (not shown) and then may be tightened and tied off as is conventional. It will be apparent to those skilled in the art that eyelets or other holes, openings, or perforations may be utilized. When loosened, the laces, and elastic material, permit the circumferences of the torso, waist, and leg sections of suit 310 to increase so that a user may more easily don the suit. Once in the suit, the wearer can tighten the laces to create a snug fit.

Similarly, zippers 335 extend substantially along the length of the front portions of the torso section 315 of the suit. As shown, the zippers may be angled from a generally vertical orientation. Typically, the zippers are angled at between about 10 to about 30° from vertical. As with the laces, when zippers 335 are unzipped, the torso section circumference of the suit increases so that a user may more easily don the suit. The zippers can then be zipped to a closed position to provide a snug fit for the wearer.

As in previous embodiments, laces 333 or zippers 335 may be replaced by buttons. hook and loop fasteners, or snaps. In each alternative embodiment, unbuttoning the buttons, separating the hook and loop fasteners, or unsnapping the snaps allows the circumferences of the torso, waist, and/or leg sections of the suit to increase, making it easier for a user to don the suit. Generally, all of these adjustable members are interchangeable, and different combinations of any of them may be utilized.

Referring now to FIGS. 24-28, yet another embodiment of the adjustable suit is illustrated. As shown, an adjustable suit 410 is shown which includes a torso section generally indicated at 411, a waist section generally indicated at 415, and a leg section generally indicated at 420. As in previous embodiments, the suit 410 is preferably made from a high tensile strength (e.g., 90 psi or greater), relatively inelastic material such as single or multi-ply polymeric fabric including polyester or nylon, and natural fibers including cotton (such as, for example, canvas or denim).

Torso section 411 includes a front portion 412 and a back portion 413. The suit provides a torso circumference 414. Waist section 415 includes a front portion 416 and a back portion 417. The suit provides a waist section circumference 418. Leg section 420 includes a pair of legs 421, 422, each having respective leg openings 427, 428, and respective leg opening circumferences 429, 430, and with each leg having respective front 423, 424 and back 425, 426 portions. A crotch panel 442 provides support to the wearer. Sections of the adjustable suit may be fabricated from a unitary piece of fabric, or may be fabricated from pieces of fabric stitched or otherwise bonded or adhered together.

Figure 24:
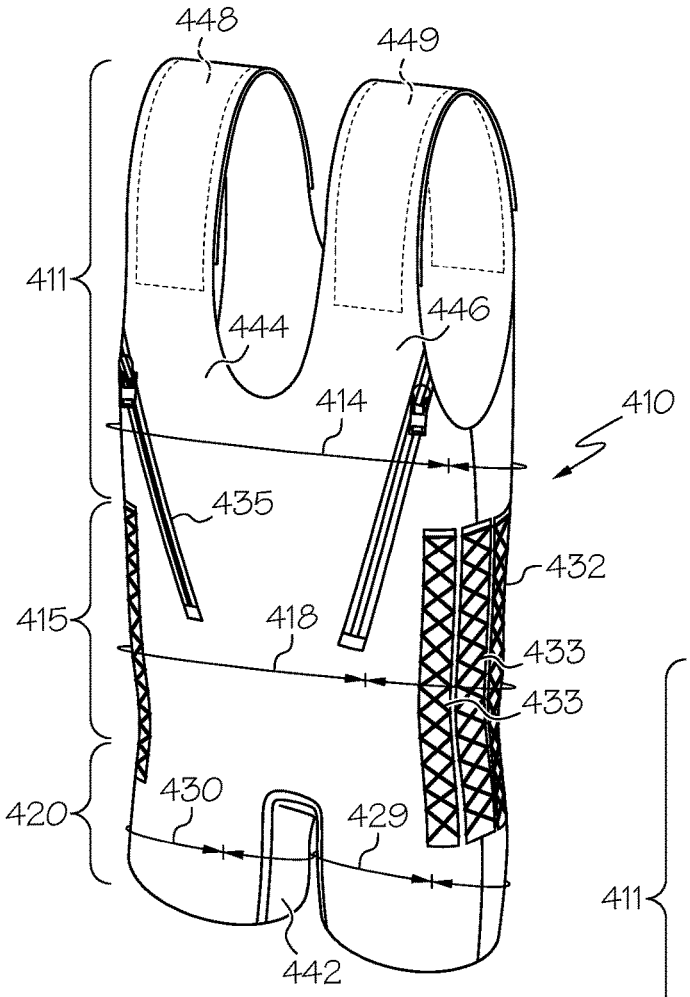
FIG. 24 is a perspective view of yet another embodiment of the adjustable suit.
Figure 25:
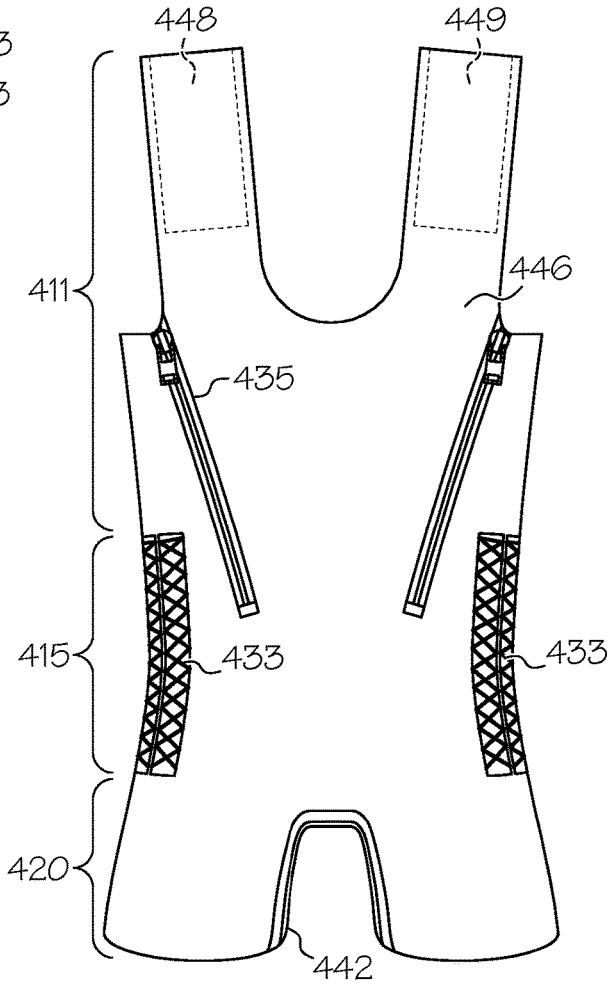
FIG. 25 is a front view of the adjustable suit of FIG. 24.
Figure 26:
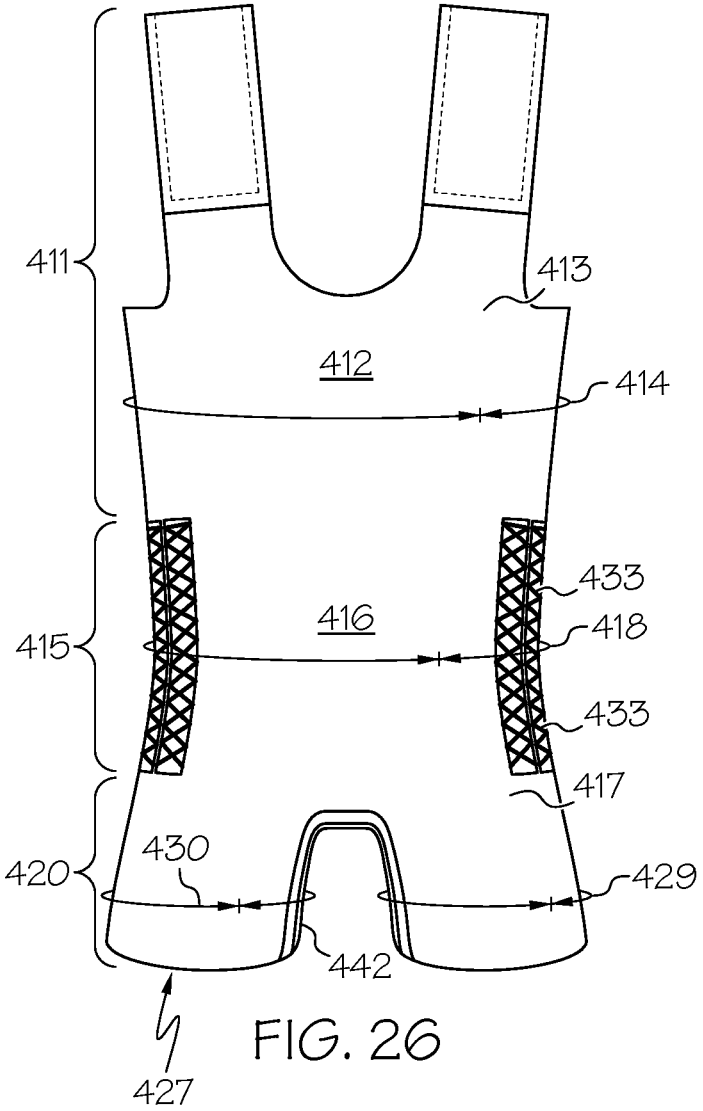
FIG. 26 is a rear view of the adjustable suit of FIG. 24.
Figure 27:
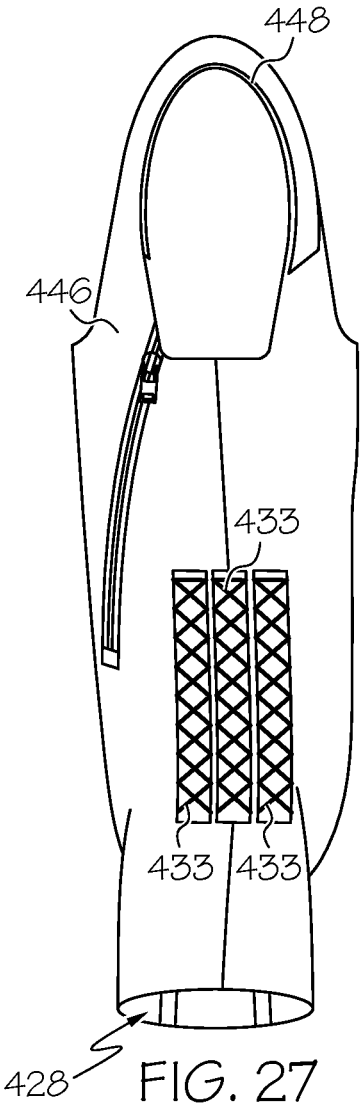
FIG. 27 is a side view of the adjustable suit of FIG. 24.
Figure 28:
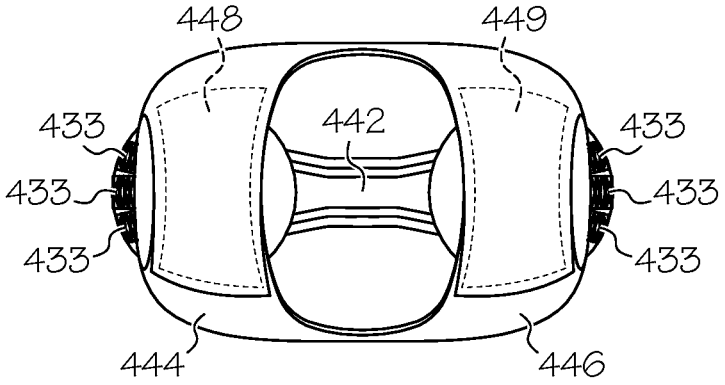
FIG. 28 is a top view of the adjustable suit of FIG. 24.

Adjustable suit 410 also includes a pair of shoulder straps 444, 446. It will be apparent to those skilled in this art that suit 410 may also include sleeves (not shown) if the suit is fabricated to include an opening in the back of the torso section. As best shown in FIGS. 24 and 25, the shoulder straps comprise lengths of fabric or other suitable high tensile strength material and are adjustable through the use of fasteners 448, 449. By making the shoulder straps adjustable, suit 410 is easier to don, and the tightness of the shoulder straps can be adjusted to fit different physiques of the wearers.

To aid in making it easier for a wearer to put on and take off the suit, adjustable suit 410 includes adjustable members 432 which are adapted to increase or decrease at least one of the (optional) torso, waist, and leg opening circumferences. The adjustable member may comprise laces 433, zippers 435, hook and loop fasteners, snaps, buttons, or any other suitable means which provides the capability of adjusting the circumference of one or more sections of the suit. To provide further adjustability, one or more of the respective front and back portions of one or more of the torso, waist, and leg sections of the suit may be joined together with an elastic material (not shown; see FIGS. 7A and 7B of previous embodiment). The elastic material may be sewn to or otherwise bonded to the respective front and back portions 412, 413 of, for example, torso section 411.

In the embodiment illustrated in FIGS. 24-28, there are eight adjustable members, two zippers 435 and six sets of laces 433. First, second, and third pairs of laces 433 extend partially along the length of the torso and waist sections of the suit, adjustably joining together respective front and back portions of the torso and waist sections of the suit. The sets of laces are arranged in side-by-side relationship providing expandable areas for a wearer to more easily don the suit. The laces may comprise any suitable length of material which will withstand the stresses and strains of supporting the wearer.

As in previous embodiments, laces 433 are laced in a criss-cross fashion through fabric loops (not shown) and then may be tightened and tied off as is conventional. It will be apparent to those skilled in the art that eyelets or other holes, openings, or perforations may be utilized. When loosened, the laces, and elastic material, permit the circumferences of the torso, waist, and leg sections of suit 410 to increase so that a user may more easily don the suit. Once in the suit, the wearer can tighten the laces to create a snug fit.

Similarly, zippers 435 extend substantially along the length of the front portions of the torso section 415 of the suit. As shown, the zippers may be angled from a generally vertical orientation. Typically, the zippers are angled at between about 10 to about 30° from vertical. As with the laces, when zippers 435 are unzipped, the torso section circumference of the suit increases so that a user may more easily don the suit. The zippers can then be zipped to a closed position to provide a snug fit for the wearer.

As in previous embodiments, laces 433 or zippers 435 may be replaced by buttons. hook and loop fasteners, or snaps. In each alternative embodiment, unbuttoning the buttons, separating the hook and loop fasteners, or unsnapping the snaps allows the circumferences of the torso, waist, and/or leg sections of the suit to increase, making it easier for a user to don the suit. Generally, all of these adjustable members are interchangeable, and different combinations of any of them may be utilized.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An adjustable suit comprising:

fabric formed of at least one of single or multi-ply polymeric fabric and fabric from natural fibers and the fabric including:

a waist section having a front portion having a first edge and an opposite second edge, a back portion having a first edge and an opposite second edge, and a waist section circumference;

a leg section including a pair of legs, each of said legs having a leg opening therein positioned adjacent a distal end of said legs, and each of said leg openings having a leg opening circumference, said waist section positioned above said leg section;

first, second, third and fourth adjustable members each extending along said waist and leg sections;

said first and second adjustable members positioned on one side of a sagittal plane of said adjustable suit and extending longitudinally along said waist and leg sections, and said third and fourth adjustable members positioned on an opposite side of said sagittal plane of said adjustable suit and extending longitudinally along said waist and leg sections;

said second and third adjustable members comprising zippers; and said first, second, third and fourth adjustable members adapted to increase or decrease leg opening circumferences, wherein said first adjustable member connects said first edge of said front portion and said first edge of said back portion, and said first adjustable member is positioned between said first edge of said front portion and said first edge of said back portion, wherein said fourth adjustable member connects said second edge of said front portion and said second edge of said back portion, and said fourth adjustable member is positioned between said second edge of said front portion and said second edge of said back portion, wherein each of said second and third adjustable members are on said leg section and only one of said front portion or said back portion of said waist section and angled diagonally across said waist section toward said leg section relative to said sagittal plane.

2. The adjustable suit as claimed in claim 1 in which said first and fourth adjustable members are selected from the group consisting of laces, zippers, hook and loop fasteners, snaps, buttons, and combinations thereof.

3. The adjustable suit as claimed in claim 2 in which said first and fourth adjustable members comprise laces.

4. The adjustable suit as claimed in claim 3 in which said laces comprise an elastic material.

5. The adjustable suit as claimed in claim 1 in which said front and back portions of said waist section are joined together with an elastic material and in which said first and fourth adjustable members overlie said elastic material.

6. The adjustable suit as claimed in claim 1 in which said second and third adjustable members are adapted to increase or decrease said waist circumference.

7. The adjustable suit as claimed in claim 1 in which each of said legs includes a front portion and a back portion.

8. The adjustable suit as claimed in claim 7 in which said front and back portions of respective legs are joined together with an elastic material.

9. The adjustable suit as claimed in claim 8 in which said first and fourth adjustable members overlie said elastic material.

10. The adjustable suit as claimed in claim 1 including fifth and sixth adjustable members.

11. The adjustable suit as claimed in claim 10 in which said fifth and sixth adjustable members comprise laces and are adapted to increase or decrease respective leg opening circumferences.

12. The adjustable suit as claimed in claim 1 further including fifth, sixth, seventh, eighth, ninth, and tenth adjustable members.

13. The adjustable suit as claimed in claim 12 in which said first, fourth, fifth, sixth, seventh, eighth, ninth, and tenth adjustable members comprise laces.

14. The adjustable suit as claimed in claim 13 in which said fifth, sixth, seventh, and eighth adjustable members extend vertically downwardly along opposing front and back portions of the waist section.

15. The adjustable suit as claimed in claim 1 further including fifth, sixth, seventh, and eighth adjustable members.

16. The adjustable suit as claimed in claim 15 in which said first, fourth, fifth, sixth, seventh, and eighth adjustable members comprise laces.

17. The adjustable suit as claimed in claim 16 in which said fifth and sixth adjustable members extend angled downwardly across the front portion of the waist section.

18. The adjustable suit as claimed in claim 17 in which said seventh and eighth adjustable members extend vertically downwardly along the length of respective front portions of the legs.

19. The adjustable suit as claimed in claim 1, wherein said second and third adjustable members are both on only said front portion of said waist section.

20. The adjustable suit as claimed in claim 1, wherein said first, second, third, and fourth adjustable members each extends across a horizontal plane extending along a circumference of said waist section.

21. An adjustable suit comprising:

fabric formed of at least one of single or multi-ply polymeric fabric and fabric from natural fibers and the fabric including:

a waist section having a front portion having a first edge and an opposite second edge, a back portion having a first edge and an opposite second edge, and a waist section circumference;

a pair of shoulder straps extending from the front portion of the waist section to the back portion of the waist section, each shoulder strap including a fastener for adjusting a length of respective shoulder straps;

a leg section including a pair of legs, each of said legs having a leg opening therein, and each of said leg openings having a leg opening circumference;

first, second, third and fourth adjustable members extending along said waist and leg sections;

said first and second adjustable members positioned on one side of a sagittal plane of said adjustable suit and extending longitudinally along said waist and leg sections, and said third and fourth adjustable members positioned on an opposite side of said sagittal plane of said adjustable suit and extending longitudinally along said waist and leg sections;

said second and third adjustable members comprising zippers; and said first, second, third and fourth adjustable members adapted to increase or decrease at least one of said waist and leg opening circumferences, wherein said first adjustable member connects said first edge of said front portion and said first edge of said back portion, and said first adjustable member is positioned between said first edge of said front portion and said first edge of said back portion, wherein said fourth adjustable member connects said second edge of said front portion and said second edge of said back portion, and said fourth adjustable member is positioned between said second edge of said front portion and said second edge of said back portion, wherein each of said second and third adjustable members are on said leg section and only one of said front portion or said back portion of said waist section and angled diagonally across said waist section toward said leg section relative to said sagittal plane.

22. The adjustable suit as claimed in claim 21 in which said first and fourth adjustable members are selected from the group consisting of laces, zippers, hook and loop fasteners, snaps, buttons, and combinations thereof.

23. The adjustable suit as claimed in claim 22 in which said first and fourth adjustable members comprise laces.

24. The adjustable suit as claimed in claim 21 in which said front and back portions of said waist section are joined together with an elastic material.

25. The adjustable suit as claimed in claim 21 in which said first and fourth adjustable members are adapted to increase or decrease said leg opening circumferences.

26. The adjustable suit as claimed in claim 21 in which said second and third adjustable members are adapted to increase or decrease said waist circumference.

27. The adjustable suit as claimed in claim 21, wherein said second and third adjustable members are both on only said front portion of said waist section.

* * * * *